US008843016B2

(12) United States Patent
Watanabe

(10) Patent No.: US 8,843,016 B2
(45) Date of Patent: Sep. 23, 2014

(54) FIXING DEVICE AND IMAGE FORMING APPARATUS INCORPORATING SAME

(75) Inventor: Masahiro Watanabe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 303 days.

(21) Appl. No.: 13/432,391

(22) Filed: Mar. 28, 2012

(65) Prior Publication Data

US 2012/0269532 A1 Oct. 25, 2012

(30) Foreign Application Priority Data

Apr. 22, 2011 (JP) ..... 2011-096270

(51) Int. Cl.
*G03G 21/20* (2006.01)
*G03G 15/20* (2006.01)

(52) U.S. Cl.
CPC ..... *G03G 15/2032* (2013.01); *G03G 15/2017* (2013.01)
USPC ..... 399/92; 399/69

(58) Field of Classification Search
USPC ..... 399/92, 69, 122, 324, 331, 335
See application file for complete search history.

(56) References Cited

U.S. PATENT DOCUMENTS

| | | | | |
|---|---|---|---|---|
| 5,956,554 | A | 9/1999 | Yanashima et al. | |
| 2002/0057934 | A1 | 5/2002 | Ishikawa et al. | |
| 2003/0035666 | A1 | 2/2003 | Ishikawa et al. | |
| 2003/0206757 | A1 | 11/2003 | Ishikawa et al. | |
| 2009/0226200 | A1 | 9/2009 | Ando | |
| 2010/0086326 | A1 * | 4/2010 | Kitozaki | 399/92 |
| 2010/0232846 | A1 | 9/2010 | Watanabe | |
| 2010/0272458 | A1 | 10/2010 | Yoshikawa | |
| 2011/0222923 | A1 | 9/2011 | Watanabe | |
| 2011/0229224 | A1 | 9/2011 | Watanabe | |
| 2012/0027444 | A1 | 2/2012 | Kitagawa | |

FOREIGN PATENT DOCUMENTS

| | | | |
|---|---|---|---|
| CN | 101526788 | A | 9/2009 |
| EP | 2 246 742 | | 11/2010 |
| JP | 01-279278 | A | 11/1989 |
| JP | 06-282185 | A | 10/1994 |
| JP | 10048981 | A | 2/1998 |
| JP | 2005-077792 | A | 3/2005 |
| JP | 2006-267426 | | 10/2006 |
| JP | 2006-330434 | A | 12/2006 |

(Continued)

OTHER PUBLICATIONS

European Search Report dated Aug. 24, 2012.

(Continued)

*Primary Examiner* — Billy Lactaoen
(74) *Attorney, Agent, or Firm* — Harness, Dickey & Pierce, P.L.C.

(57) ABSTRACT

A fixing device includes a moving assembly that moves a second rotary body and an airflow guide between a first position and a second position, the first position where the second rotary body contacts a first rotary body to form a fixing nip therebetween through which a recording medium bearing an unfixed toner image is conveyed and a constant first interval between the second rotary body and the airflow guide is smaller than a variable second interval between the second rotary body and an exhaust duct, the second position where the second rotary body is isolated from the first rotary body and the constant first interval between the second rotary body and the airflow guide is equivalent to the variable second interval between the second rotary body and the exhaust duct.

13 Claims, 12 Drawing Sheets

(56) References Cited

FOREIGN PATENT DOCUMENTS

| | | | | |
|---|---|---|---|---|
| JP | 2006-330556 | A | | 12/2006 |
| JP | 2007-079033 | A | | 3/2007 |
| JP | 2007057775 | A | | 3/2007 |
| JP | 2007-086538 | A | | 4/2007 |
| JP | 2007328161 | A | * | 12/2007 |
| JP | 2008-185697 | A | | 8/2008 |
| JP | 2010-256696 | A | | 11/2010 |

OTHER PUBLICATIONS

Chinese Office Action mailed May 26, 2014.

* cited by examiner 1
62
62a
64
65
R3
R4
D1
R2
84
85
86
68
R1
63a
87
69
67
63
83
66
6
T
P

86

NON-PRESSING STATE

PRESSING STATE

PRESSING STATE

NON-PRESSING STATE

FIG. 10A PRESSING STATE
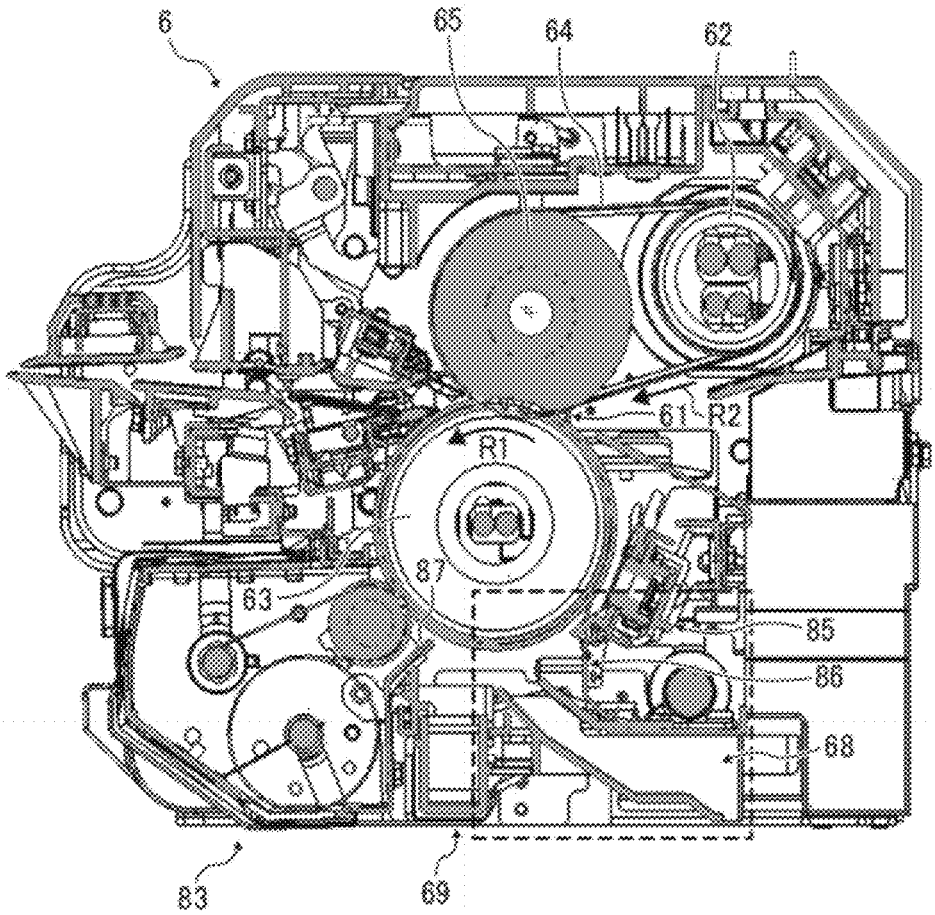
FIG. 10B
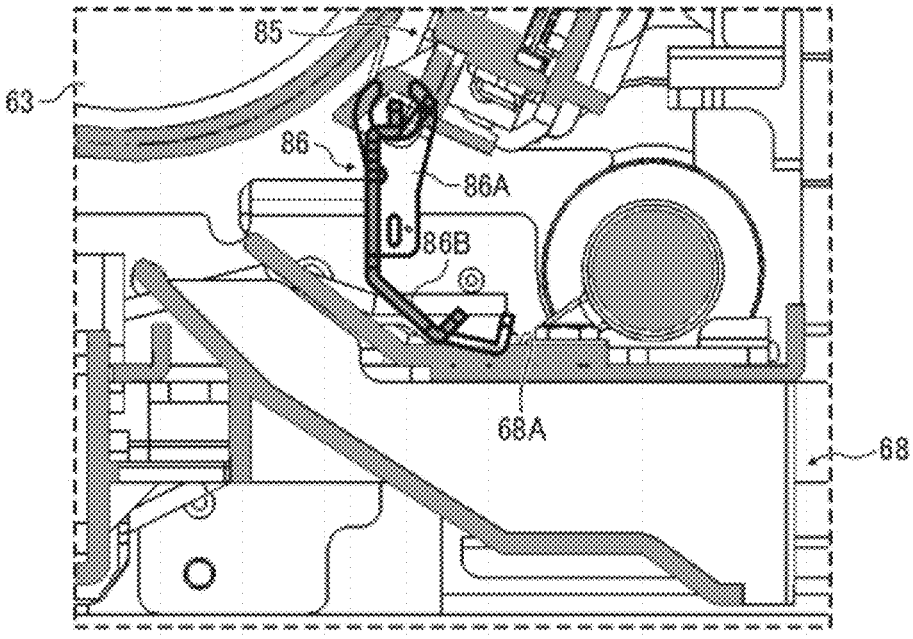

FIG. 10C NON-PRESSING STATE
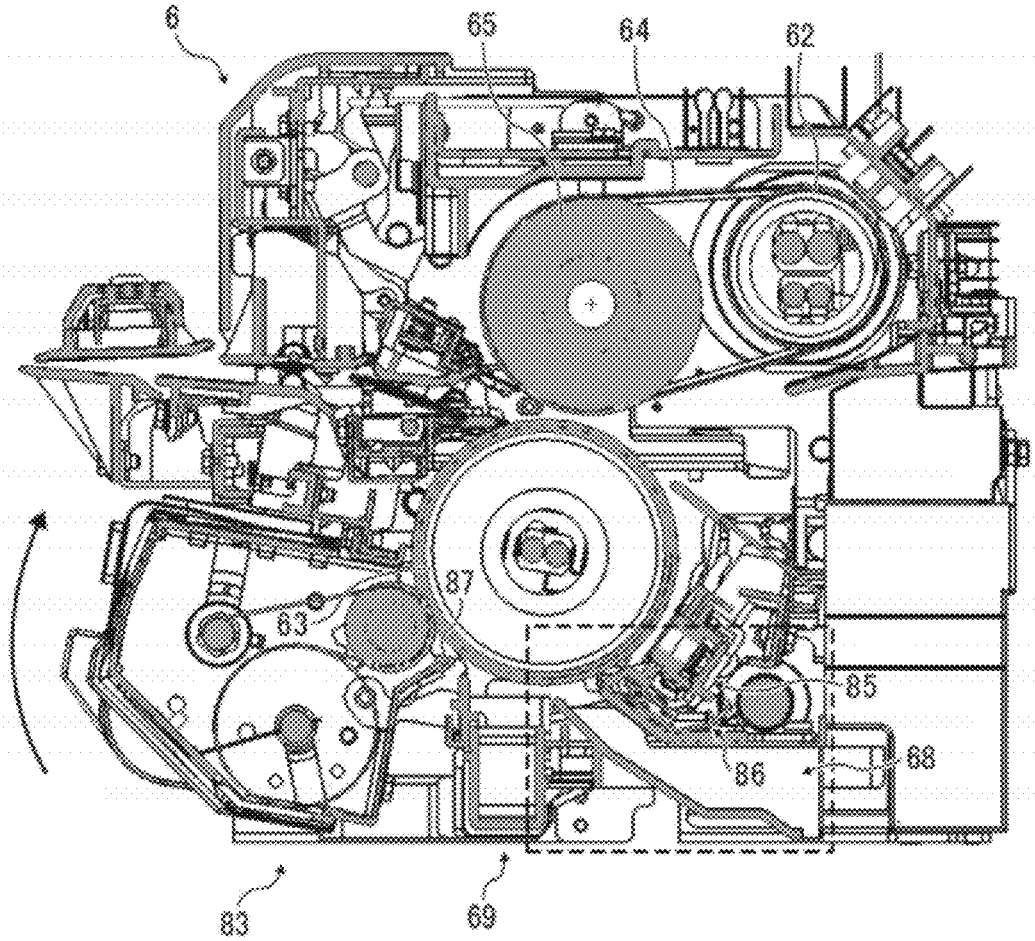
FIG. 10D
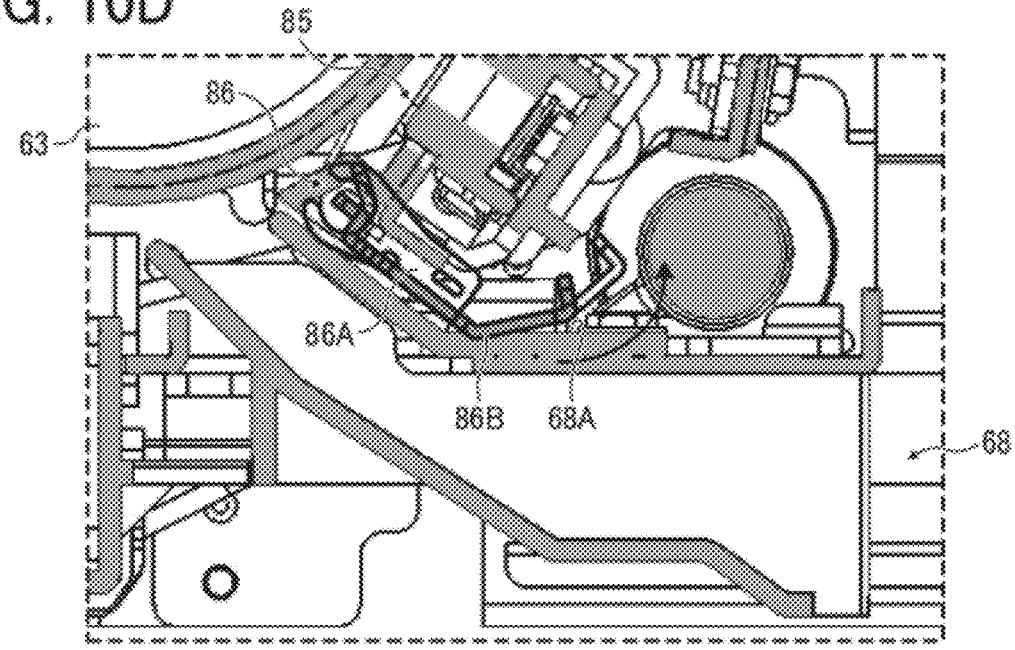

FIXING DEVICE AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2011-096270, filed on Apr. 22, 2011, in the Japanese Patent Office, the entire disclosure of which is hereby incorporated herein by reference.

FIELD OF THE INVENTION

Example embodiments generally relate to a fixing device and an image forming apparatus, and more particularly, to a fixing device for fixing a toner image on a recording medium and an image forming apparatus including the fixing device.

BACKGROUND OF THE INVENTION

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then collects residual toner not transferred and remaining on the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may employ a fixing rotary body (e.g., a roller, an endless belt, or an endless film) heated by a heater and a pressing rotary body (e.g., a roller or a belt) pressed against the fixing rotary body to form a fixing nip therebetween through which the recording medium bearing the unfixed toner image is conveyed. As the recording medium passes through the fixing nip in a state in which the front side of the recording medium that bears the unfixed toner image contacts the fixing rotary body, the fixing rotary body heated by the heater and the pressing rotary body apply heat and pressure to the recording medium, thus melting and fixing the toner image on the recording medium. In duplex printing, the recording medium is reversed after it is discharged from the fixing device and then conveyed through the fixing nip again in a state in which the back side of the recording medium that bears the unfixed toner image contacts the fixing rotary body and the front side of the recording medium that bears the fixed toner image contacts the pressing rotary body. Thus, the fixing rotary body and the pressing rotary body fix the toner image on the back side of the recording medium.

In duplex printing, it is important to prevent overheating of the pressing rotary body, which may cause failures described below. For example, if the surface temperature of the pressing rotary body is excessively higher than the surface temperature of the fixing rotary body, the gloss level of the toner image formed on the front side of the recording medium may be different from the gloss level of the toner image formed on the back side of the recording medium or minute scratches on the surface of the pressing rotary body may damage the toner image formed on the recording medium. These failures are conspicuous when glossy paper or coated paper in increasing demand is used as the recording medium.

To address this circumstance, the fixing device may incorporate a fan that produces airflow inside a housing of the fixing device, which impinges on the surface of the pressing rotary body to cool it. However, airflow may also impinge on a temperature detector that should be protected against airflow to detect the surface temperature of the pressing rotary body precisely, resulting in erroneous detection and malfunction of the temperature detector.

Alternatively, the fan may blow air on the pressing rotary body through an intake duct. However, airflow from an outlet of the intake duct may be directed to the temperature detector disposed downstream from the intake duct in the rotation direction of the pressing rotary body upon impingement on the pressing rotary body, resulting in erroneous detection and malfunction of the temperature detector. Moreover, airflow from the intake duct may not be directed to an exhaust duct disposed upstream from the intake duct in the rotation direction of the pressing rotary body through which airflow is exhausted to the outside of the fixing device, but directed to a component (e.g., a cleaner that cleans the pressing rotary body) disposed upstream from the exhaust duct in the rotation direction of the pressing rotary body.

Accordingly, airflow heated by the pressing rotary body upon impingement thereon may leak from an airflow path extending from the outlet of the intake duct to an inlet of the exhaust duct and diffuse to the components other than the pressing rotary body. Consequently, the pressing rotary body may be cooled by airflow inefficiently and the diffused airflow may overheat the components other than the pressing rotary body, resulting in malfunction of the overheated components and coagulation of toner of the toner image that degrades the quality of the toner image.

SUMMARY OF THE INVENTION

At least one embodiment may provide a fixing device that includes a first rotary body rotatable in a predetermined direction of rotation and a movable unit disposed opposite the first rotary body and movable with respect to the first rotary body. The movable unit includes a second rotary body rotatable in a direction counter to the direction of rotation of the first rotary body and an airflow guide spaced apart from an outer circumferential surface of the second rotary body with a constant first interval therebetween. The fixing device further includes an airflow generator to generate airflow; an intake duct, disposed opposite the outer circumferential surface of the second rotary body, through which the airflow generated by the airflow generator impinges on the outer circumferential surface of the second rotary body; an exhaust duct disposed opposite the outer circumferential surface of the second rotary body and interposed between the airflow guide and the intake duct in the direction of rotation of the second rotary body, the exhaust duct through which the airflow reflected by the second rotary body travels and including a guide wall spaced apart from the outer circumferential surface of the second rotary body with a variable second interval therebetween; and a moving assembly connected to the movable unit to move the second rotary body and the airflow guide between a first position and a second position, the first position where the second rotary body contacts the first rotary body to form a fixing nip therebetween through which a recording medium bearing an unfixed toner image is conveyed and the constant first interval is smaller than the variable second interval to cause the airflow guide to guide the airflow reflected by the second rotary body to the exhaust duct, the second position where the second rotary body is isolated from the first rotary body and the constant first interval is equivalent to the variable second interval to cause the guide wall of the exhaust duct to guide the airflow reflected by the second rotary body to the exhaust duct.

At least one embodiment may provide an image forming apparatus that includes the fixing device described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein:

FIG. 10A is a vertical sectional view of the fixing device shown in FIG. 9A in the pressing state;

FIG. 10B is an enlarged vertical sectional view of the components enclosed by the dotted box in FIG. 10A;

FIG. 10C is a vertical sectional view of the fixing device shown in FIG. 9B in the non-pressing state; and FIG. 10D is an enlarged vertical sectional view of the components enclosed by the dotted box in FIG. 10C.

Figure 1:
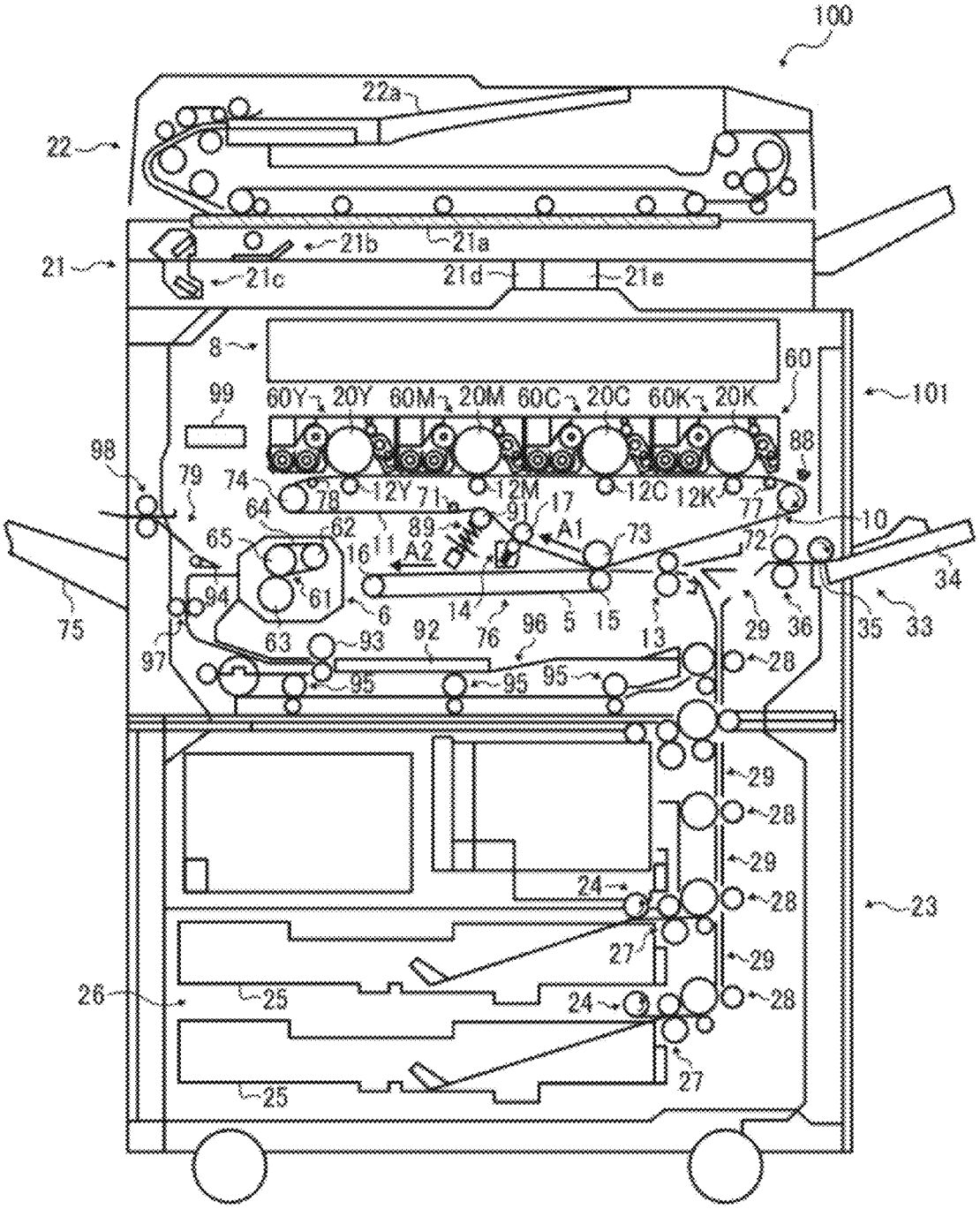
FIG. 1 is a schematic vertical sectional view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF THE INVENTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 100 according to an example embodiment is explained.

FIG. 1 is a schematic vertical sectional view of the image forming apparatus 100. The image forming apparatus 100 may be a copier, a facsimile machine, a printer, a multifunction printer having at least one of copying, printing, scanning, plotter, and facsimile functions, or the like. According to this example embodiment, the image forming apparatus 100 is a multifunction printer (MFP) incorporating at least copying, printing, and facsimile functions to form monochrome and color toner images on a recording medium by electrophotography. When the image forming apparatus 100 is used as a printer, it performs image forming operation according to an image signal converted from image data sent from an external device (e.g., a client computer). The image forming apparatus 100 performs image forming operation similarly when it is used as a facsimile machine.

The image forming apparatus 100 forms a toner image on sheet type recording media such as plain paper generally used for copying, overhead projector (OHP) transparencies, thick paper (e.g., cards and postcards), glossy paper, coated paper, and envelopes. The image forming apparatus 100 also forms a toner image on both sides, that is, front and back sides, of a sheet serving as a recording medium.

Referring to FIG. 1, the following describes the structure of the image forming apparatus 100.

The image forming apparatus 100 includes a body 101 disposed in a center portion thereof in a vertical direction; a reader 21 (e.g., a scanner) disposed above the body 101 to read an image on an original document; an auto document feeder (ADF) 22 disposed above the reader 21 to load a plurality of original documents to be fed to the reader 21; and a sheet feeder 23 disposed below the body 101 to load a plurality of sheets serving as recording media to be fed to the body 101.

The image forming apparatus 100 is a tandem image forming apparatus employing a tandem image forming mechanism, that is, an image forming device 60, which incorporates photoconductive drums 20Y, 20M, 20C, and 20K serving as a plurality of image carriers that carry yellow, magenta, cyan, and black toner images, respectively. The photoconductive drums 20Y, 20M, 20C, and 20K having an identical diameter are aligned in a horizontal direction with an identical interval between the adjacent photoconductive drums 20Y, 20M, 20C, and 20K and disposed opposite an outer circumferential surface of an endless intermediate transfer belt 11 disposed in substantially a center portion of the body 101 in the vertical direction. The intermediate transfer belt 11 serves as an intermediate transferor that carries the yellow, magenta, cyan, and black toner images transferred from the photoconductive drums 20Y, 20M, 20C, and 20K.

The intermediate transfer belt 11 is rotatable clockwise in FIG. 1 in a rotation direction A1 in a state in which the intermediate transfer belt 11 is disposed opposite the photoconductive drums 20Y, 20M, 20C, and 20K. The yellow, magenta, cyan, and black toner images visualized as described below are transferred from the photoconductive drums 20Y, 20M, 20C, and 20K onto the intermediate transfer belt 11 rotating in the rotation direction A1 in such a manner that the yellow, magenta, cyan, and black toner images are superimposed on a same position on the intermediate transfer belt 11, and then collectively transferred onto a sheet. Thus, the image forming apparatus 100 employs an intermediate transfer method or an indirect transfer method in which the yellow, magenta, cyan, and black toner images formed on the photoconductive drums 20Y, 20M, 20C, and 20K, respectively, are transferred onto the sheet indirectly via the intermediate transfer belt 11.

For example, primary transfer rollers 12Y, 12M, 12C, and 12K serving as a primary transfer device are pressed against the photoconductive drums 20Y, 20M, 20C, and 20K, respectively, via the intermediate transfer belt 11 to form primary transfer nips between the photoconductive drums 20Y, 20M, 20C, and 20K and the intermediate transfer belt 11. As the intermediate transfer belt 11 rotates in the rotation direction A1, the primary transfer rollers 12Y, 12M, 12C, and 12K apply a voltage at the primary transfer nips at different times successively from the upstream photoconductive drum 20Y to the downstream photoconductive drum 20K in the rotation direction A1. Accordingly, the yellow, magenta, cyan, and black toner images are transferred from the photoconductive drums 20Y, 20M, 20C, and 20K onto the intermediate transfer belt 11 successively in such a manner that they are superimposed on the same position on the intermediate transfer belt 11. Thus, a color toner image is formed on the intermediate transfer belt 11.

The intermediate transfer belt 11 may be manufactured in various methods with various materials. For example, the intermediate transfer belt 11 may be made of polyimide (PI) resin that provides a desired strength. According to this example embodiment, PI is used. Alternatively, the intermediate transfer belt 11 may be made of polyvinylidene fluoride (PVDF), ethylene-tetrafluoroethylene copolymer (ETFE), polycarbonate (PC), or the like.

The photoconductive drums 20Y, 20M, 20C, and 20K are arranged in this order in the rotation direction A1 from left to right in FIG. 1. The photoconductive drums 20Y, 20M, 20C, and 20K are incorporated in four image forming units, that is, image forming stations 60Y, 60M, 60C, and 60K that form the yellow, magenta, cyan, and black toner images, respectively.

The image forming stations 60Y, 60M, 60C, and 60K are incorporated in the image forming device 60. Below the image forming device 60 is an intermediate transfer belt unit 10 incorporating the intermediate transfer belt 11. Below the intermediate transfer belt unit 10 is a secondary transfer unit 76 serving as a secondary transfer device that transfers the color toner image formed on the intermediate transfer belt 11 onto a sheet while conveying the sheet. The secondary transfer unit 76 includes an endless secondary transfer belt 5 disposed opposite and in contact with the intermediate transfer belt 11 to form a secondary transfer nip therebetween. The secondary transfer belt 5 rotates counterclockwise in FIG. 1 in a rotation direction A2 counter to the rotation direction A1 of the intermediate transfer belt 11 so that the intermediate transfer belt 11 and the secondary transfer belt 5 nip and convey the sheet in a sheet conveyance direction.

Above the image forming device 60 is an optical scanner 8 serving as an exposure device, an optical writer, or an optical writing unit that is disposed opposite the image forming stations 60Y, 60M, 60C, and 60K to optically write electrostatic latent images on the photoconductive drums 20Y, 20M, 20C, and 20K of the image forming stations 60Y, 60M, 60C, and 60K, respectively. Upstream from the secondary transfer unit 76 in the sheet conveyance direction is a registration roller pair 13 that feeds the sheet conveyed from the sheet feeder 23 to the secondary transfer nip formed between the intermediate transfer belt 11 and the secondary transfer belt 5 at a time when the color toner image formed on the intermediate transfer belt 11 reaches the secondary transfer nip. In proximity to the registration roller pair 13 is a sensor that detects a leading edge of the sheet reaching the registration roller pair 13.

Downstream from the secondary transfer unit 76 in the sheet conveyance direction is a fixing device 6 (e.g., a fuser unit) that fixes the color toner image on the sheet conveyed from the secondary transfer unit 76. Downstream from the fixing device 6 in the sheet conveyance direction is an output unit 79 incorporating an output path that discharges the sheet bearing the fixed color toner image to an outside of the image forming apparatus 100 and a reverse path that conveys the sheet bearing the fixed color toner image to the registration roller pair 13 via a duplex unit 96 disposed below the fixing device 6 for duplex printing. For example, when a user selects duplex printing, the sheet bearing the fixed color toner image on the front side thereof which is discharged from the fixing device 6 is conveyed through the reverse path of the output unit 79 to the duplex unit 96. The duplex unit 96 reverses the sheet by switching back the sheet and conveys the sheet to the registration roller pair 13 so that the registration roller pair 13 feeds the sheet to the secondary transfer nip where another toner image formed on the intermediate transfer belt 11 is transferred onto the back side of the sheet.

By contrast, when the user does not select the duplex printing, the sheet discharged from the fixing device 6 is discharged onto an output tray 75 attached to one side of the body 101 where a plurality of sheets bearing a fixed toner image is stacked. A bypass tray unit 33 is attached to another side of the body 101 to load one or more recording media such as OHP transparencies, cards, and envelopes. The image forming apparatus 100 further includes a control panel disposed atop the body 101 with which the user inputs a print job; and a controller 99 disposed inside the body 101 to control overall operations of the image forming apparatus 100.

A detailed description is now given of the reader 21.

The reader 21 includes an exposure glass 21*a* disposed atop the reader 21 and a first moving body 21*b*, a second moving body 21*c*, an image forming lens 21*d*, and a sensor 21*e* disposed below the exposure glass 21*a*. For example, a light source emits light onto an original document placed on the exposure glass 21*a*. As the first moving body 21*b* moves from left to right and vice versa in the horizontal direction in FIG. 1, a first reflector mounted on the first moving body 21*b* reflects the light reflected by the original document toward the second moving body 21*c*. Then, a second reflector mounted on the second moving body 21*c* reflects the light reflected by the first reflector of the first moving body 21*b* toward the image forming lens 21*d* that forms an image according to the light received from the second moving body 21*c*. The sensor 21*e* reads the image formed by the image forming lens 21*d*. Thereafter, the image is converted into an image signal and sent to the optical scanner 8.

A detailed description is now given of the ADF 22.

The ADF 22 includes an original document tray 22*a* on which an original document is placed. The ADF 22 is pivotable with respect to the reader 21. For example, when the user lifts the ADF 22, the exposure glass 21*a* of the reader 21 is exposed. Before the image forming apparatus 100 starts a copying operation, the user sets an original document on the original document tray 22*a* of the ADF 22. Alternatively, the user lifts the ADF 22, places the original document on the exposure glass 21*a*, and lowers the ADF 22 so that the ADF 22 presses the original document against the exposure glass 21*a*.

A detailed description is now given of the control panel and the controller 99.

The control panel is mounted with a start button, number keys, mode selection keys, and other buttons and keys. For example, the user sets the original document on the original document tray 22*a* or the exposure glass 21*a*, enters the number of sheets used for copying by using the number keys, selects an image forming mode, that is, a color mode or a monochrome mode, by using the mode selection keys, and finally presses the start button to start the copying operation. The controller 99 is a central processing unit (CPU) provided with a random-access memory (RAM) and a read-only memory (ROM), for example.

A detailed description is now given of the optical scanner 8.

The optical scanner 8 exposes an outer circumferential surface of the respective photoconductive drums 20Y, 20M, 20C, and 20K by scanning it with laser beams, thus forming electrostatic latent images on the photoconductive drums 20Y, 20M, 20C, and 20K. For example, a light source emits laser beams onto the outer circumferential surface of the respective photoconductive drums 20Y, 20M, 20C, and 20K according to an image signal sent from the reader 21. Specifically, a polygon mirror driven and rotated by a polygon motor reflects the laser beams emitted by the light source to a plurality of optical elements. The optical elements cause the laser beams to scan the outer circumferential surface of the respective photoconductive drums 20Y, 20M, 20C, and 20K in a main scanning direction parallel to an axial direction of the respective photoconductive drums 20Y, 20M, 20C, and 20K, thus forming electrostatic latent images thereon.

A detailed description is now given of the intermediate transfer belt unit 10.

In addition to the intermediate transfer belt 11, the intermediate transfer belt unit 10 includes a plurality of rollers that supports the intermediate transfer belt 11 and an intermediate transfer belt cleaner 14. For example, the intermediate transfer belt 11 is stretched over the primary transfer rollers 12Y, 12M, 12C, and 12K, a driving roller 72, a transfer entry roller 73, and support rollers 17, 91, 71, 74, 78, and 77. The intermediate transfer belt cleaner 14 is disposed opposite the outer circumferential surface of the intermediate transfer belt 11 and serves as an intermediate transferor cleaner that cleans the outer circumferential surface of the intermediate transfer belt 11 after the color toner image is transferred onto the sheet therefrom.

The intermediate transfer belt unit 10 further includes an optical sensor 88 disposed opposite the driving roller 72 via the intermediate transfer belt 11 and a biasing device 89 attached to the support roller 91. For example, the optical sensor 88, serving as an optical detector, optically detects the toner image carried on the intermediate transfer belt 11. The biasing device 89 biases the support roller 91 against the intermediate transfer belt 11.

The intermediate transfer belt unit 10 further includes a driver (e.g., a motor) that drives and rotates the driving roller 72; a power supply that applies a primary transfer bias to the primary transfer rollers 12Y, 12M, 12C, and 12K by applying a high voltage; and a bias controller that controls the power supply to adjust the primary transfer bias.

For example, as the driver drives and rotates the driving roller 72 which in turn rotates the intermediate transfer belt 11, the driven rollers, that is, the primary transfer rollers 12Y, 12M, 12C, and 12K, the transfer entry roller 73, and the support rollers 17, 91, 71, 74, 78, and 77, are rotated by the intermediate transfer belt 11 stretched over the driven rollers. Among the plurality of rollers over which the intermediate transfer belt 11 is stretched, the primary transfer rollers 12Y, 12M, 12C, and 12K, the driving roller 72, the transfer entry roller 73, and the support rollers 17, 71, 74, 78, and 77 are disposed inside a loop formed by the intermediate transfer belt 11. By contrast, the support roller 91 is disposed outside the loop formed by the intermediate transfer belt 11.

Each of the primary transfer rollers 12Y, 12M, 12C, and 12K is constructed of a metal core and a surface layer made of resin foam coating the metal core. The metal core is made of iron. Alternatively, the metal core may be made of SUS stainless steel, aluminum, or the like. The surface layer has a thickness in a range of from about 2 mm to about 10 mm. According to this example embodiment, the thickness of the surface layer is about 5 mm. Alternatively, the surface layer may have a thickness outside the range described above.

The primary transfer rollers 12Y, 12M, 12C, and 12K are interposed between the support rollers 78 and 77 in the rotation direction A1 and contact an inner circumferential surface of the intermediate transfer belt 11 to press against the photoconductive drums 20Y, 20M, 20C, and 20K via the intermediate transfer belt 11, thus forming the primary transfer nips between the intermediate transfer belt 11 and the photoconductive drums 20Y, 20M, 20C, and 20K, respectively.

As the power supply applies the primary transfer bias to the primary transfer rollers 12Y, 12M, 12C, and 12K, a primary transfer electric field is created between the photoconductive drums 20Y, 20M, 20C, and 20K and the primary transfer rollers 12Y, 12M, 12C, and 12K at the primary transfer nips, respectively. The yellow, magenta, cyan, and black toner images formed on the photoconductive drums 20Y, 20M, 20C, and 20K are primarily transferred onto the intermediate transfer belt 11 by the primary transfer electric field and pressure exerted by the primary transfer rollers 12Y, 12M, 12C, and 12K to the photoconductive drums 20Y, 20M, 20C, and 20K, respectively.

The intermediate transfer belt cleaner 14 includes a cleaning brush and a cleaning blade disposed opposite the support roller 17, disposed downstream from the transfer entry roller 73 in the rotation direction A1, via the intermediate transfer belt 11 and in contact with the outer circumferential surface of the intermediate transfer belt 11. The cleaning brush and the cleaning blade scrape a foreign substance such as residual toner not transferred onto the sheet and therefore remaining on the intermediate transfer belt 11 off the intermediate transfer belt 11, thus cleaning the outer circumferential surface of the intermediate transfer belt 11. Hence, the support roller 17 serves as an opposed roller disposed opposite the intermediate transfer belt cleaner 14.

The support roller 91 is disposed downstream from the support roller 17 in the rotation direction A1 and in contact with the outer circumferential surface of the intermediate transfer belt 11 that bears the color toner image. As the biasing device 89 biases the support roller 91 against the intermediate transfer belt 11, the support roller 91 works as a tension roller that exerts a given tension to the intermediate transfer belt 11, facilitating transfer of the color toner image from the intermediate transfer belt 11 onto the sheet.

The optical sensor 88 is disposed opposite the driving roller 72 via the intermediate transfer belt 11 to detect the color toner image on the intermediate transfer belt 11. Accordingly, the driving roller 72 serves as an opposed roller disposed opposite the optical sensor 88 via the intermediate transfer belt 11. For example, the driving roller 72 is a rubber roller constructed of a metal core and a rubber layer made of ethylene propylene (EP) rubber wound around an outer circumferential surface of the metal core. An axial direction of the driving roller 72 is parallel to the main scanning direction. The metal core is produced by extrusion and made of aluminum. Alternatively, the metal core may be made of iron, SUS stainless steel, or the like. The rubber layer has a thickness of about 0.5 mm.

A detailed description is now given of the sheet feeder 23.

The sheet feeder 23 includes a paper bank 26 serving as a sheet feeder unit incorporating a plurality of paper trays 25; a plurality of pickup rollers 24; a plurality of separation roller pairs 27; a plurality of conveyance roller pairs 28; and a conveyance path 29. For example, each paper tray 25 loads a plurality of sheets. Each pickup roller 24 contacts and picks up an uppermost sheet of the plurality of sheets loaded on the paper tray 25. Each separation roller pair 27 separates the uppermost sheet picked up by the pickup roller 24 from other sheets and feeds the uppermost sheet to the conveyance roller pair 28. Each conveyance roller pair 28 conveys the sheet fed by the separation roller pair 27 to the registration roller pair 13 through the conveyance path 29. The conveyance path 29 extends into the body 101 where another conveyance roller pair 28 is disposed in proximity to the registration roller pair 13. Specifically, as the pickup roller 24 is driven and rotated counterclockwise in FIG. 1 and the separation roller pair 27 is rotated, the pickup roller 24 and the separation roller pair 27 feed the uppermost sheet to the conveyance path 29. Then, the rotating conveyance roller pairs 28 convey the sheet to the registration roller pair 13. When a leading edge of the sheet strikes the registration roller pair 13, the registration roller pair 13 halts the sheet.

A detailed description is now given of the bypass tray unit 33.

The bypass tray unit 33 includes a bypass tray 34 that loads a plurality of sheets; a pickup roller 35 that contacts and picks up an uppermost sheet of the sheets loaded on the bypass tray 34; a separation roller pair 36 that separates the uppermost sheet picked up by the pickup roller 35 from other sheets; and a sensor that detects the sheets placed on the bypass tray 34. For example, as the pickup roller 35 is driven and rotated clockwise in FIG. 1 and the separation roller pair 36 is rotated, the separation roller pair 36 guides the uppermost sheet to the conveyance path 29 situated inside the body 101 and connected to the registration roller pair 13. When a leading edge of the sheet strikes the registration roller pair 13, the registration roller pair 13 halts the sheet.

A detailed description is now given of the secondary transfer unit 76.

In addition to the secondary transfer belt 5, the secondary transfer unit 76 includes a driving roller 15 and a driven roller 16 over which the secondary transfer belt 5 is stretched and a power supply that applies a secondary transfer bias having a polarity opposite a polarity of toner of the color toner image to the driving roller 15.

The driving roller 15 is disposed opposite the transfer entry roller 73 via the secondary transfer belt 5 and the intermediate transfer belt 11. Since the driving roller 15 and the transfer entry roller 73 sandwich the secondary transfer belt 5 and the intermediate transfer belt 11, the secondary transfer nip is created between the secondary transfer belt 5 and the intermediate transfer belt 11 contacting each other. As the power supply applies the secondary transfer bias to the driving roller 15, a secondary transfer electric field is created at the secondary transfer nip, where the driving roller 15 electrostatically transfers the color toner image from the intermediate transfer belt 11 to the sheet nipped and conveyed between the intermediate transfer belt 11 and the secondary transfer belt 5. For example, the color toner image is transferred onto the sheet fed by the registration roller pair 13 and conveyed between the intermediate transfer belt 11 and the secondary transfer belt 5 by the secondary transfer electric field and pressure exerted between the intermediate transfer belt 11 and the secondary transfer belt 5.

Accordingly, the transfer entry roller 73 presses against the driving roller 15 via the intermediate transfer belt 11 and the secondary transfer belt 5, thus serving as a support roller that creates the secondary transfer nip where the color toner image is transferred from the intermediate transfer belt 11 onto the sheet. The transfer entry roller 73 also serves as a backup roller disposed opposite the driving roller 15 to form the secondary transfer nip while serving as a repulsive roller that exerts a repulsive force against the driving roller 15 applied with the secondary transfer bias.

The secondary transfer unit 76 also conveys the sheet bearing the color toner image transferred from the intermediate transfer belt 11 to the fixing device 6.

Alternatively, the secondary transfer unit 76 may employ a secondary transfer roller or a non-contact charger. However, in this case, an extra component that conveys the sheet bearing the color toner image to the fixing device 6 is needed in addition to the secondary transfer roller or the non-contact charger.

A brief description is now given of the fixing device 6.

The fixing device 6 includes a heating roller 62 serving as a rotary body; a fixing roller 65 serving as a rotary body; a fixing belt 64, serving as a first rotary body, stretched over the heating roller 62 and the fixing roller 65; and a pressing roller 63, serving as a second rotary body, pressed against the fixing roller 65 via the fixing belt 64 to form a fixing nip 61 between the pressing roller 63 and the fixing belt 64 through which the sheet bearing the color toner image is conveyed. As the sheet is conveyed through the fixing nip 61, the fixing belt 64 heated by the heating roller 62 and the pressing roller 63 apply heat and pressure to the sheet, fixing the color toner image on the sheet.

A detailed description is now given of the output unit 79. It is to be noted that a detailed description of the fixing device 6 is deferred.

The output unit 79 includes a conveyance roller pair 97 that conveys the sheet bearing the fixed color toner image discharged from the fixing device 6 to the duplex unit 96; an output roller pair 98 that discharges the sheet bearing the fixed color toner image discharged from the fixing device 6 onto the output tray 75; and a switch pawl 94 that guides the sheet to the output path mounted with the output roller pair 98 or the reverse path mounted with the conveyance roller pair 97.

A detailed description is now given of the duplex unit 96.

The duplex unit 96 includes a tray 92 that temporarily stores the sheet bearing the fixed color toner image on the front side thereof that is conveyed from the output unit 79; a reverse roller pair 93 that switches back the sheet placed on the tray 92; and a plurality of feed roller pairs 95 that feeds the sheet conveyed from the reverse roller pair 93 to the registration roller pair 13.

A detailed description is now given of the image forming stations 60Y, 60M, 60C, and 60K.

Figure 2:
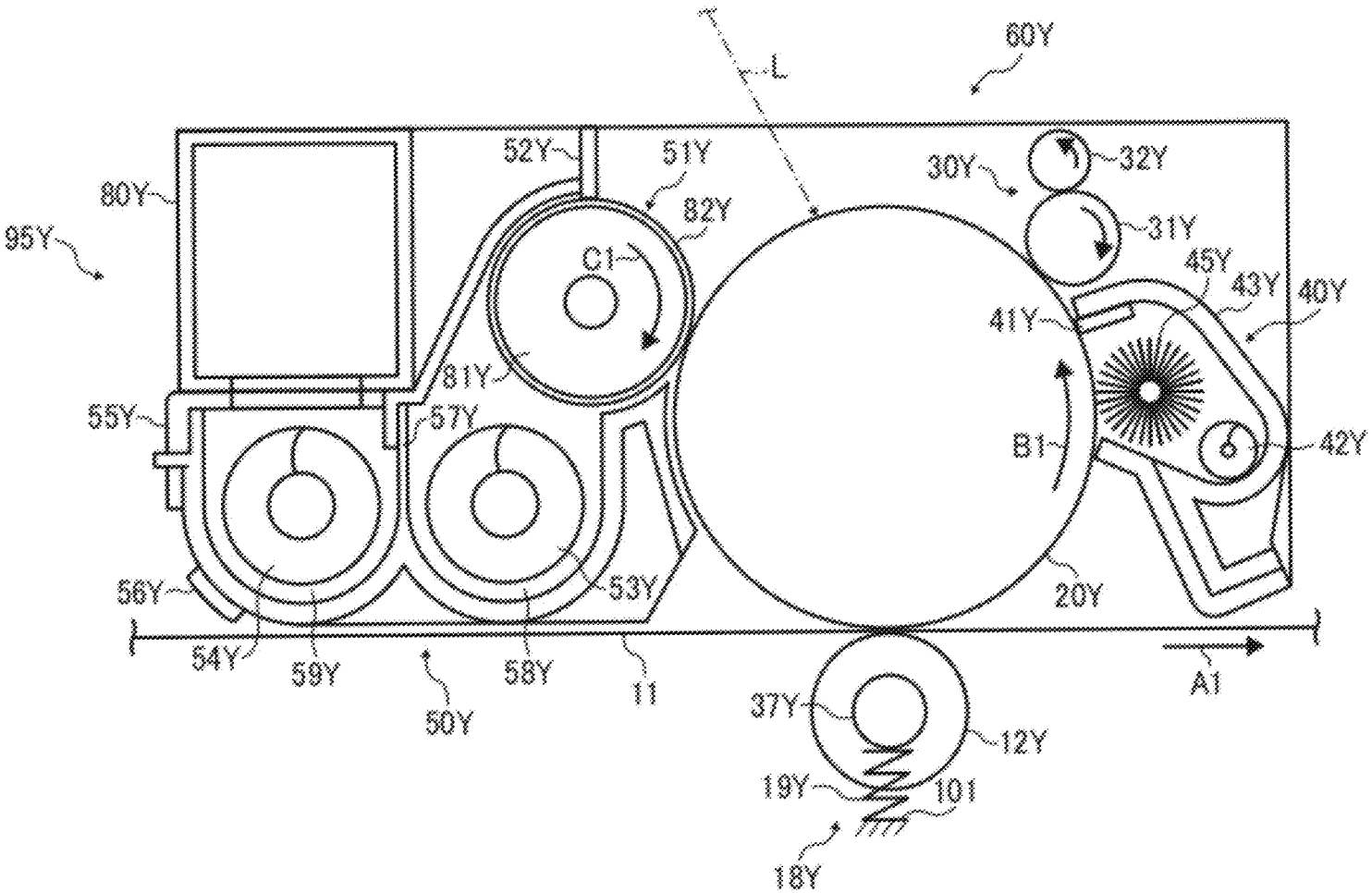
FIG. 2 is a vertical sectional view of an image forming station installed in the image forming apparatus shown in FIG. 1.

Since the image forming stations 60Y, 60M, 60C, and 60K have an identical structure, the following describes the structure of the image forming station 60Y that forms a yellow toner image with reference to FIG. 2. Therefore, descriptions of the image forming stations 60M, 60C, and 60K are omitted. The suffixes Y, M, C, and K are added to the reference numerals of the components used to form yellow, magenta, cyan, and black toner images, respectively.

FIG. 2 is a vertical sectional view of the image forming station 60Y incorporating the photoconductive drum 20Y. As shown in FIG. 2, the photoconductive drum 20Y is surrounded by a charger 30Y (e.g., a charging unit), a development device 50Y (e.g., a development unit), a pressing assembly 18Y, and a cleaner 40Y (e.g., a cleaning unit) arranged in this order in a rotation direction B1 of the photoconductive drum 20Y. Although not shown, a discharger also surrounds the photoconductive drum 20Y. The pressing assembly 18Y includes the primary transfer roller 12Y that contacts the inner circumferential surface of the intermediate transfer belt 11 and a spring 19Y that presses the primary transfer roller 12Y against the photoconductive drum 20Y via the intermediate transfer belt 11 with a given pressure.

The photoconductive drum 20Y, the charger 30Y, the development device 50Y, the cleaner 40Y, and the discharger are integrated into a process cartridge 95Y. The process cartridge 95Y is detachably attached to the body 101. For example, when the user pulls the process cartridge 95Y, the process cartridge 95Y slides over a guide rail mounted on the body 101 and comes out of the body 101 so that the user removes the process cartridge 95Y from the body 101. Conversely, when the user sets the process cartridge 95Y on the guide rail and pushes it into the body 101, the process cartridge 95Y slides over the guide rail and is placed at a given position where the process cartridge 95Y performs an image forming operation. The process cartridge 95Y is replaceable as a replacement part, facilitating maintenance.

According to this example embodiment, the photoconductive drum 20Y, the charger 30Y, the development device 50Y, the cleaner 40Y, and the discharger are integrated into the process cartridge 95Y. Alternatively, at least the photoconductive drum 20Y and the development device 50Y may be integrated into a unit as a process cartridge detachably attached to the body 101.

A detailed description is now given of the charger 30Y.

The charger 30Y includes a charging roller 31Y contacting the outer circumferential surface of the photoconductive drum 20Y and driven and rotated by the rotating photoconductive drum 20Y and a cleaning roller 32Y contacting an outer circumferential surface of the charging roller 31Y and driven and rotated by the charging roller 31Y. The charging roller 31Y is connected to a voltage applier that applies a superimposed bias composed of an alternating current component superimposed on a direct current component to the charging roller 31Y. The charging roller 31Y discharges the outer circumferential surface of the photoconductive drum 20Y and at the same time charges it at a given polarity in a charging region where the charging roller 31Y is disposed opposite the photoconductive drum 20Y.

As the cleaning roller 32Y is driven and rotated by the charging roller 31Y, the cleaning roller 32Y cleans the outer circumferential surface of the charging roller 31Y. As described above, according to this example embodiment, the image forming station 60Y employs a charging system using the charging roller 31Y that charges the photoconductive drum 20Y by contacting it. Alternatively, the image forming station 60Y may employ a charging system using a non-contact roller disposed in proximity to the photoconductive drum 20Y that charges the photoconductive drum 20Y without contacting it in a scorotron method, for example.

A detailed description is now given of the pressing assembly 18Y.

The primary transfer roller 12Y contacts the inner circumferential surface of the intermediate transfer belt 11 and presses the intermediate transfer belt 11 against the photoconductive drum 20Y. The primary transfer roller 12Y is supported by the body 101 and rotatable about a shaft 37Y serving as a rotation axis of the primary transfer roller 12Y. A bias controller controls a bias applier incorporating a power supply to apply a given voltage to the primary transfer roller 12Y that primarily transfers a yellow toner image formed on the photoconductive drum 20Y onto the intermediate transfer belt 11.

The spring 19Y is situated between the shaft 37Y and the body 101 and serves as a biasing member that biases the shaft 37Y against the intermediate transfer belt 11. The shaft 37Y is supported by a support in such a manner that the shaft 37Y is movable in the vertical direction. With the configuration described above of the pressing assembly 18Y, the spring 19Y exerts a resilient bias to the primary transfer roller 12Y via the shaft 37Y which in turn presses the intermediate transfer belt 11 against the photoconductive drum 20Y upward in FIG. 2 in the vertical direction.

The optical scanner 8 depicted in FIG. 1 emits light L optically modulated according to image data, that is, an image signal sent from the reader 21 depicted in FIG. 1, onto a region on the photoconductive drum 20Y interposed between the charger 30Y and the development device 50Y in the rotation direction B1 of the photoconductive drum 20Y, thus exposing the outer circumferential surface of the photoconductive drum 20Y charged by the charging roller 31Y. Accordingly, an electrostatic latent image is formed on the photoconductive drum 20Y, which is to be visualized as a yellow toner image by the development device 50Y.

The cleaner 40Y includes a cleaning case 43Y, a brush roller 45Y, a cleaning blade 41Y, and a screw 42Y. For example, the cleaning case 43Y accommodates the brush roller 45Y, the cleaning blade 41Y, and the screw 42Y and has an opening disposed opposite the photoconductive drum 20Y. The brush roller 45Y rotatably contacts the photoconductive drum 20Y to scrape a foreign substance such as residual toner particles, carrier particles, and paper dust off the photoconductive drum 20Y, thus cleaning the photoconductive drum 20Y. The cleaning blade 41Y, disposed downstream from the brush roller 45Y in the rotation direction B1 of the photoconductive drum 20Y, contacts the photoconductive drum 20Y and scrapes the foreign substance not removed by the brush roller 45Y off the photoconductive drum 20Y, thus cleaning the photoconductive drum 20Y. The screw 42Y is rotatably supported by the cleaning case 43Y and constitutes a part of a waste toner conveyance path that conveys the foreign substance scraped off and removed from the photoconductive drum 20Y by the brush roller 45Y and the cleaning blade 41Y, that is generally called waste toner, to a waste toner container.

A detailed description is now given of the development device 50Y.

The development device 50Y includes a development case 55Y, a development roller 51Y, and a development blade 52Y. For example, the development case 55Y has an opening disposed opposite the photoconductive drum 20Y. The development roller 51Y protrudes from the opening of the development case 55Y toward the photoconductive drum 20Y and is disposed in close proximity to the photoconductive drum 20Y. The development roller 51Y serves as a developer carrier that carries a developer (e.g., toner containing toner particles and carrier particles). The development blade 52Y (e.g., a doctor) serves as a regulator that regulates the developer carried on the development roller 51Y at a given height.

The development device 50Y further includes a first conveyance screw 53Y, a second conveyance screw 54Y, a wall 57Y interposed between the first conveyance screw 53Y and the second conveyance screw 54Y, a first compartment 58Y accommodating the first conveyance screw 53Y, and a second compartment 59Y accommodating the second conveyance screw 54Y. For example, the first conveyance screw 53Y is disposed opposite the second conveyance screw 54Y via the wall 57Y in a lower portion of the development case 55Y. As the first conveyance screw 53Y rotates in a first rotation direction and the second conveyance screw 54Y rotates in a second rotation direction counter to the first rotation direction of the first conveyance screw 53Y, they agitate the developer contained in the development case 55Y and at the same time supply the developer to the development roller 51Y, thus serving as a developer supplier that supplies the developer to the development roller 51Y. The wall 57Y divides the lower portion of the development case 55Y into the first compartment 58Y and the second compartment 59Y that serve as a developer container containing the developer.

The development device 50Y further includes a toner hopper 80Y that stores yellow toner used to form a yellow toner image; and a toner density sensor 56Y attached to a lower portion of the second compartment 59Y and serving as a toner density detector that detects the density of toner particles contained in the developer.

The development device 50Y further includes a bias applier that applies a development bias of a direct current component; a roller driver that drives the development roller 51Y; a screw driver that drives and rotates the first conveyance screw 53Y in the first rotation direction and the second conveyance screw 54Y in the second rotation direction counter to the first rotation direction of the first conveyance screw 53Y; and a toner replenisher that replenishes yellow toner from the toner hopper 80Y to the second compartment 59Y.

The development roller 51Y includes a magnetic roller 81Y serving as a magnetic field generator; and a non-magnetic development sleeve 82Y that accommodates the magnetic roller 81Y and is driven and rotated by the driver clockwise in FIG. 2 in a rotation direction C1. The magnetic roller 81Y includes a plastic roller fixedly disposed in the development case 55Y; and a magnet block constructed of a plurality of magnets embedded in the plastic roller to generate a plurality of magnetic poles. The development sleeve 82Y is rotatably supported by the development case 55Y and the magnetic roller 81Y. The bias applier applies a development bias of a given size to a development region, that is, a gap between the development sleeve 82Y and the photoconductive drum 20Y. A gap, that is, a development gap, in a range of from about 0.25 mm to about 0.35 mm is provided between the photoconductive drum 20Y and the development sleeve 82Y.

The development blade 52Y is made of SUS stainless steel. A gap, that is, a doctor gap, in a range of from about 0.46 mm to about 0.54 mm is provided between the development sleeve 82Y and the development blade 52Y.

The developer is a two-component developer containing toner particles and carrier particles. The carrier particles are magnetic carriers each of which is constructed of a core and a surface resin layer that coats the core. The surface resin layer contains conductive particles each of which is constructed of a base and a surface conductive layer constructed of a tin dioxide layer and an indium oxide layer coating the tin dioxide layer. A toner particle has a shape factor SF-1 in a range of from about 100 to about 180 and a shape factor SF-2 in a range of from about 100 to about 180.

The controller 99 depicted in FIG. 1 controls the density of the toner particles contained in the developer based on a detection result provided by the toner density sensor 56Y in a range of about 4 weight percent to about 11 weight percent. A rate of the toner particles mixed with the carrier particles is constantly maintained at a given value, facilitating formation of a high quality toner image. When the toner density sensor 56Y detects that the density of the toner particles contained in the developer is below the lower limit of the above-described range as the density of the toner particles contained in the developer decreases in accordance with consumption of the toner particles for development, the toner replenisher supplies the toner particles from the toner hopper 80Y to the second compartment 59Y.

The first conveyance screw 53Y and the second conveyance screw 54Y extend in a width direction, that is, a longitudinal direction or an axial direction, of the development roller 51Y. As the screw driver drives and rotates the first conveyance screw 53Y, the first conveyance screw 53Y conveys the developer contained in the first compartment 58Y from a rear to a front of the first compartment 58Y in the axial direction of the development roller 51Y, thus supplying the developer to the development roller 51Y. The developer conveyed to a position in proximity to one end of the first compartment 58Y in the axial direction of the development roller 51Y by the first conveyance screw 53Y enters the second compartment 59Y through a window created in the wall 57Y.

As the screw driver drives and rotates the second conveyance screw 54Y, the second conveyance screw 54Y conveys the developer conveyed from the first compartment 58Y in a direction opposite a direction in which the first conveyance screw 53Y conveys the developer. When the toner hopper 80Y supplies the toner particles to the second compartment 59Y, the second conveyance screw 54Y conveys the supplied toner particles while agitating and mixing the toner particles with the developer. The developer conveyed to a position in proximity to one end of the second compartment 59Y in the axial direction of the development roller 51Y by the second conveyance screw 54Y returns to the first compartment 58Y through another window created in the wall 57Y.

The toner particles supplied from the toner hopper 80Y to the second compartment 59Y are conveyed by the second conveyance screw 54Y and the first conveyance screw 53Y while being agitated and mixed with the developer contained in the second compartment 59Y and the first compartment 58Y. Accordingly, the supplied toner particles are charged by friction, and then supplied to the development roller 51Y together with the carrier particles and carried by the development roller 51Y.

The developer carried on the development roller 51Y is regulated by the development blade 52Y to have a given layer thickness, and then conveyed to the development region situated between the development roller 51Y and the photoconductive drum 20Y by the development roller 51Y. As the bias applier applies a development bias to the development region, yellow toner particles contained in the developer electrostatically move to an electrostatic latent image formed on the outer circumferential surface of the photoconductive drum 20Y, visualizing the electrostatic latent image into a yellow toner image. The developer, having a decreased amount of yellow toner particles after the yellow toner particles are consumed for development, returns into the first compartment 58Y in accordance with rotation of the development roller 51Y. According to this example embodiment, the bias applier applies the development bias composed of the direct current component. Alternatively, the development bias may be composed of the alternating current component or may be a superimposed bias composed of the alternating current component superimposed on the direct current component.

The developer agitated and conveyed by the first conveyance screw 53Y and the second conveyance screw 54Y is attracted up to the development sleeve 82Y by a magnetic force generated by the magnetic roller 81Y. Then, the developer is conveyed to the development region where the development roller 51Y is disposed opposite the photoconductive drum 20Y. At the development region, the yellow toner particles are supplied to the electrostatic latent image formed on the photoconductive drum 20Y, visualizing the electrostatic latent image into the yellow toner image. The developer containing the decreased yellow toner particles is released from an outer circumferential surface of the development sleeve 82Y and enters the first compartment 58Y. Then, the developer is agitated and mixed with the developer contained in the first compartment 58Y and the second compartment 59Y while being conveyed by the first conveyance screw 53Y and the second conveyance screw 54Y. Thereafter, the developer is attracted up to the outer circumferential surface of the development sleeve 82Y again. The above-described cycle is repeated by the magnet block of the magnetic roller 81Y.

During the cycle, the toner particles contained in the developer are consumed and therefore the density of the toner particles contained in the developer is decreased. To address this circumstance, the toner density sensor 56Y detects the density of the toner particles contained in the developer. For example, the toner density sensor 56Y measures the density of the toner particles contained in the developer based on the magnetic permeability of the developer. A detection result provided by the toner density sensor 56Y is sent to the controller 99 as a voltage Vout based on which the controller 99 determines the density of the toner particles contained in the developer in weight percent unit.

If the density of the toner particles contained in the developer decreases, the rate of the carrier particles contained in the developer increases and thereby the magnetic permeability increases. By contrast, if the density of the toner particles contained in the developer increases, the rate of the carrier particles contained in the developer decreases and thereby the magnetic permeability decreases. That is, as the density of the toner particles contained in the developer decreases, the voltage Vout increases. Accordingly, when the controller 99 recognizes that the density of the toner particles contained in the developer is decreased based on the voltage Vout output from the toner density sensor 56Y, the controller 99 drives the toner replenisher until the voltage Vout recovers a given value, thus supplying the toner particles from the toner hopper 80Y to the second compartment 59Y.

Referring to FIGS. 1 and 2, the following describes a print operation of the image forming apparatus 100 having the structure described above to form a color toner image on a sheet.

When the image forming apparatus 100 is used as a copier, the user sets an original document on the ADF 22 or places an original document on the exposure glass 21*a*, and then presses the start button on the control panel. Alternatively, when the image forming apparatus 100 is used as a printer, the user selects image data for an image to be printed on a sheet by using an external device, such as a client computer, connected to the image forming apparatus 100, and then selects a print button on a computer screen.

When the original document is set on the ADF 22, the ADF 22 feeds the original document onto the exposure glass 21*a* upon pressing the start button on the control panel, and then the reader 21 reads an image on the original document. When the original document is placed on the exposure glass 21*a*, the reader 21 reads an image on the original document upon pressing the start button on the control panel. Thus, the reader 21 generates image data. For example, in order to read the image on the original document, as the first moving body 21*b* and the second moving body 21*c* move, the light source emits light onto the original document. The light reflected by the original document is deflected by the first moving body 21*b* toward the second moving body 21*c*. The second moving body 21*c* deflects the light by 180 degrees toward the image forming lens 21*d* that forms the image according to the light. Then, the sensor 21*e* reads the image into image data.

Upon receiving the image data from the reader 21 or the external device, the image forming stations 60Y, 60M, 60C, and 60K start an image forming operation described below. For example, in the image forming station 60Y shown in FIG. 2, as the photoconductive drum 20Y rotates in the rotation direction B1, the charging roller 31Y uniformly charges the outer circumferential surface of the photoconductive drum 20Y. The optical scanner 8 emits a laser beam L onto the charged outer circumferential surface of the photoconductive drum 20Y, forming an electrostatic latent image thereon according to yellow image data contained in the image data sent from the reader 21 or the external device. The development device 50Y visualizes the electrostatic latent image with yellow toner into a yellow toner image. The primary transfer roller 12Y primarily transfers the yellow toner image onto the intermediate transfer belt 11 rotating in the rotation direction A1. The cleaner 40Y removes a foreign substance containing residual toner not transferred onto the intermediate transfer belt 11 and therefore remaining thereon from the intermediate transfer belt 11. Finally, the discharger discharges the outer circumferential surface of the photoconductive drum 20Y. Then, the charging roller 31Y charges the outer circumferential surface of the photoconductive drum 20Y for a next image forming operation.

Similarly, also in the image forming stations 60M, 60C, and 60K, magenta, cyan, and black toner images are formed on the photoconductive drums 20M, 20C, and 20K, respectively. The primary transfer rollers 12M, 12C, and 12K primarily transfer the magenta, cyan, and black toner images onto the same position on the outer circumferential surface of the intermediate transfer belt 11 rotating in the rotation direction A1 successively in such a manner that the magenta, cyan, and black toner images are superimposed on the yellow toner image, thus forming a color toner image on the intermediate transfer belt 11. In accordance with rotation of the intermediate transfer belt 11 in the rotation direction A1, the color toner image formed on the intermediate transfer belt 11 moves to the secondary transfer nip formed between the intermediate transfer belt 11 and the secondary transfer belt 5 where the color toner image is secondarily transferred onto a sheet conveyed from the sheet feeder 23.

For example, the sheet is fed by one of the feed rollers 24 selected according to the sheet size and orientation contained in the image data. The feed roller 24 feeds the uppermost sheet from the paper tray 25 installed in the paper bank 26 toward the registration roller pair 13 while the separation roller pair 28 separates the uppermost sheet from other sheets loaded in the paper tray 25. Alternatively, the sheet is fed from the bypass tray 34 installed in the bypass tray unit 33 by the pickup roller 35 while the separation roller pair 36 separates the sheet from other sheets loaded on the bypass tray 34. Yet alternatively, the sheet is fed by the feed roller pair 95 of the duplex unit 96. In either case, the sheet is conveyed through the conveyance path 29 to the registration roller pair 13 and halted temporarily by the registration roller pair 13 when it strikes the registration roller pair 13. The registration roller pair 13 resumes conveying the sheet toward the secondary transfer nip formed between the intermediate transfer belt 11 and the secondary transfer belt 5 according to a detection signal generated by a sensor that detects a time when a leading edge of the color toner image formed on the intermediate transfer belt 11 reaches the secondary transfer nip. Thus, the registration roller pair 13 feeds the sheet to the secondary transfer nip at the time when the color toner image formed on the intermediate transfer belt 11 is secondarily transferred onto the sheet.

The sheet bearing the color toner image transferred from the intermediate transfer belt 11 is conveyed by the secondary transfer unit 76 to the fixing device 6. As the sheet is conveyed through the fixing nip 61 formed between the fixing belt 64 and the pressing roller 63, the fixing belt 64 and the pressing roller 63 apply heat and pressure to the sheet, fixing the color toner image on the sheet and thus completing formation of the color toner image on the sheet. The sheet discharged from the fixing device 6 is guided by the switch pawl 94 either toward the output tray 75 through the output roller pair 98 that discharges the sheet onto the output tray 75 where the sheet is stacked or toward the duplex unit 96 through the conveyance roller pair 97 for duplex printing. When the sheet enters the duplex unit 96, it reverses and conveys the sheet toward the registration roller pair 13 that feeds the sheet toward the secondary transfer unit 76 again where another color toner image is secondarily transferred onto the back side of the sheet. Then, the sheet is conveyed to the fixing device 6 that fixes the color toner image on the back side of the sheet. Thereafter, the sheet bearing the fixed color toner image on both sides thereof is discharged onto the output tray 75 through the output roller pair 98.

On the other hand, after the secondary transfer of the color toner image onto the sheet, the intermediate transfer belt cleaner 14 removes residual toner not transferred onto the sheet and therefore remaining on the intermediate transfer belt 11 therefrom. Thus, the intermediate transfer belt 11 is ready for the next image forming operation.

Figure 3A:
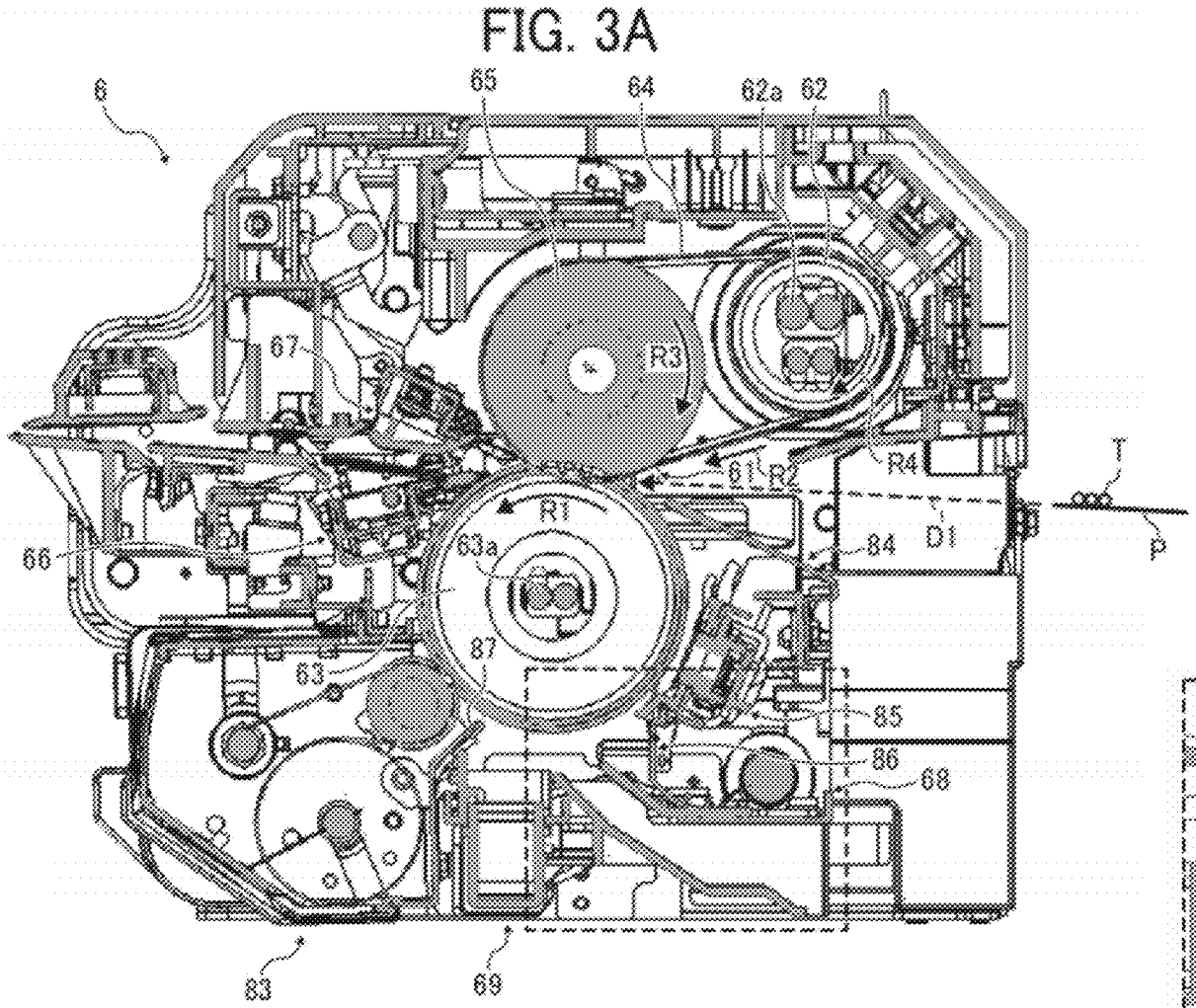
FIG. 3A is a vertical sectional view of a fixing device installed in the image forming apparatus shown in FIG. 1.
Figure 3B:
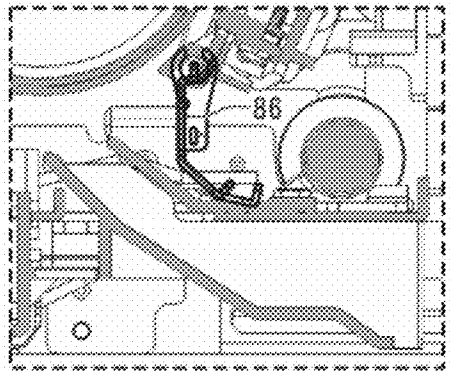
FIG. 3B is a vertical sectional view of a shield incorporated in the fixing device shown in FIG. 3A.

Referring to FIGS. 3A and 3B, the following describes the fixing device 6 installed in the image forming apparatus 100 described above.

FIG. 3A is a vertical sectional view of the fixing device 6. FIG. 3B is a vertical sectional view of a shield 86 incorporated in the fixing device 6. As shown in FIG. 3A, the fixing device 6 further includes a separation plate unit 66 disposed downstream from the fixing nip 61 in a sheet conveyance direction D1 in which a sheet P bearing a toner image T is conveyed to separate the sheet P discharged from the fixing nip 61 from the pressing roller 63; and a separation plate unit 67 disposed downstream from the fixing nip 61 in the sheet conveyance direction D1 to separate the sheet P discharged from the fixing nip 61 from the fixing belt 64.

The fixing device 6 further includes an intake duct 68 and an exhaust duct 69 disposed opposite the pressing roller 63. Air taken in from an outside of the body 101 of the image forming apparatus 100 depicted in FIG. 1 travels through the intake duct 68 serving as a first airflow path and impinges on an outer circumferential surface of the pressing roller 63 as intake airflow. Air impinging on the pressing roller 63 and reflected by it is exhausted through the exhaust duct 69 serving as a second airflow path to the outside of the body 101 as exhaust airflow.

A cleaner 83 that cleans the outer circumferential surface of the pressing roller 63 is disposed opposite the outer circumferential surface of the pressing roller 63 and is interposed between the separation plate unit 66 and the exhaust duct 69 in a rotation direction R1 of the pressing roller 63. A sheet guide 84 is disposed upstream from the fixing nip 61 in the sheet conveyance direction D1 to guide the sheet P to the fixing nip 61.

An anti overheat assembly 85, disposed opposite the pressing roller 63 and upstream from the sheet guide 84 in the rotation direction R1 of the pressing roller 63, prevents overheating of the pressing roller 63. The shield 86 (e.g., a plate assembly), disposed opposite the pressing roller 63 and interposed between the intake duct 68 and the anti overheat assembly 85 in the rotation direction R1 of the pressing roller 63, shields the anti overheat assembly 85 against airflow from the intake duct 68.

An airflow guide 87, disposed opposite the pressing roller 63 and constituting one end of a stay of the cleaner 83, guides airflow blown from the intake duct 68 and impinging on the pressing roller 63 to the exhaust duct 69.

Referring to FIGS. 4A, 4B, 5A, and 5B, the following describes units detachably installed in the fixing device 6.

Figure 4A:
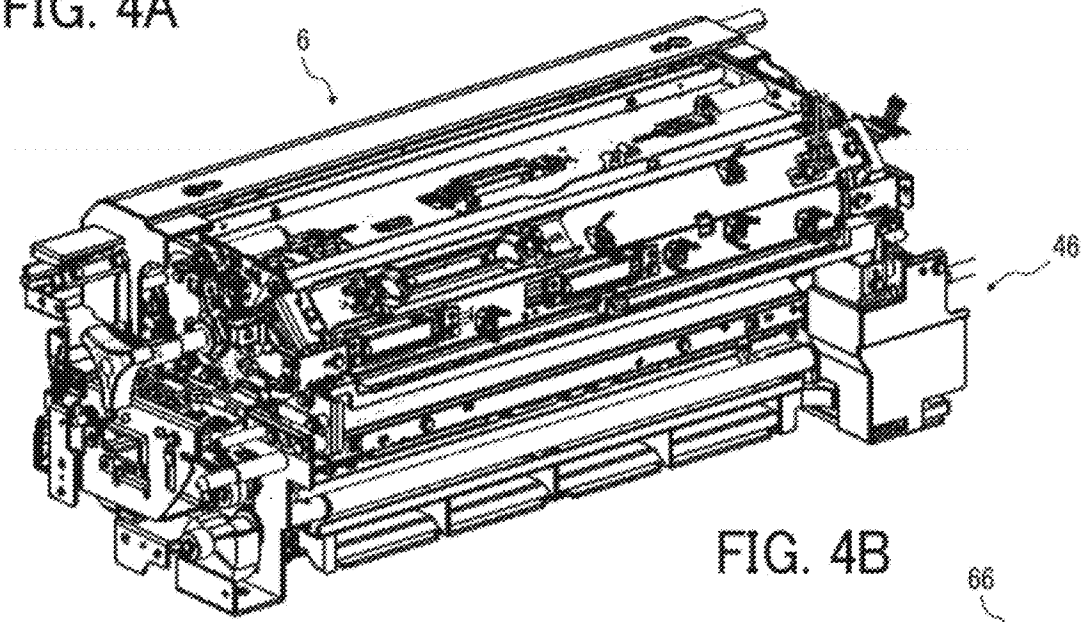
FIG. 4A is a perspective view of the fixing device shown in FIG. 3A.
Figure 4B:
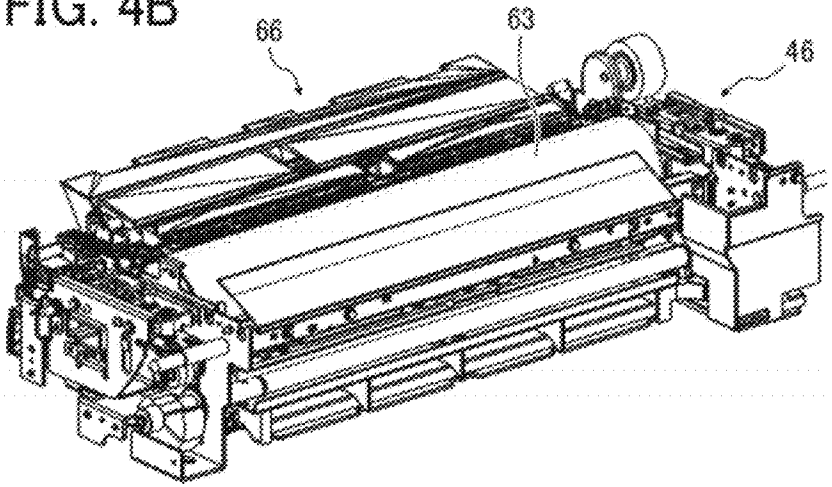
FIG. 4B is a perspective view of a lower fixing unit detached from the fixing device shown in FIG. 4A.
Figure 5A:
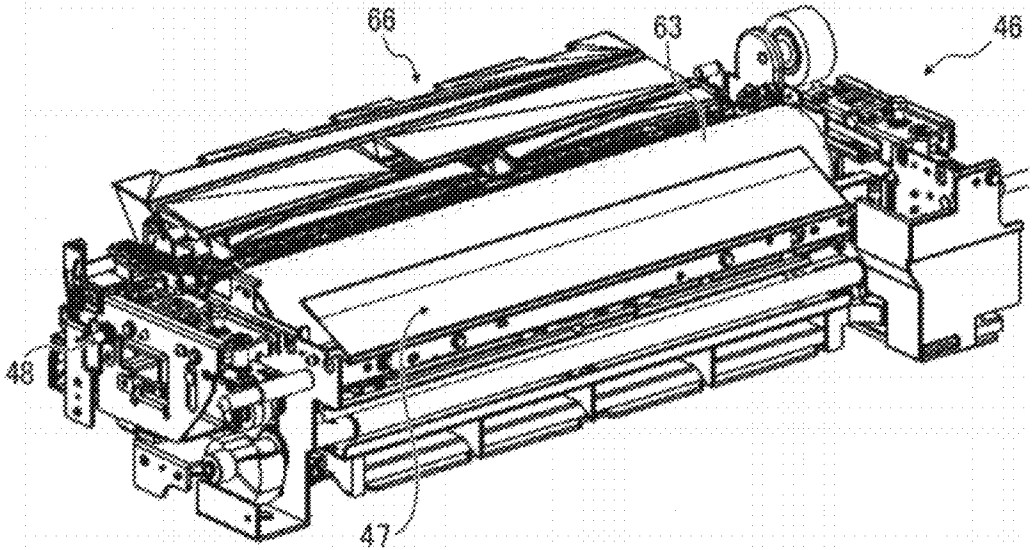
FIG. 5A is a perspective view of the lower fixing unit shown in FIG. 4B illustrating a shaft incorporated therein.
Figure 5B:
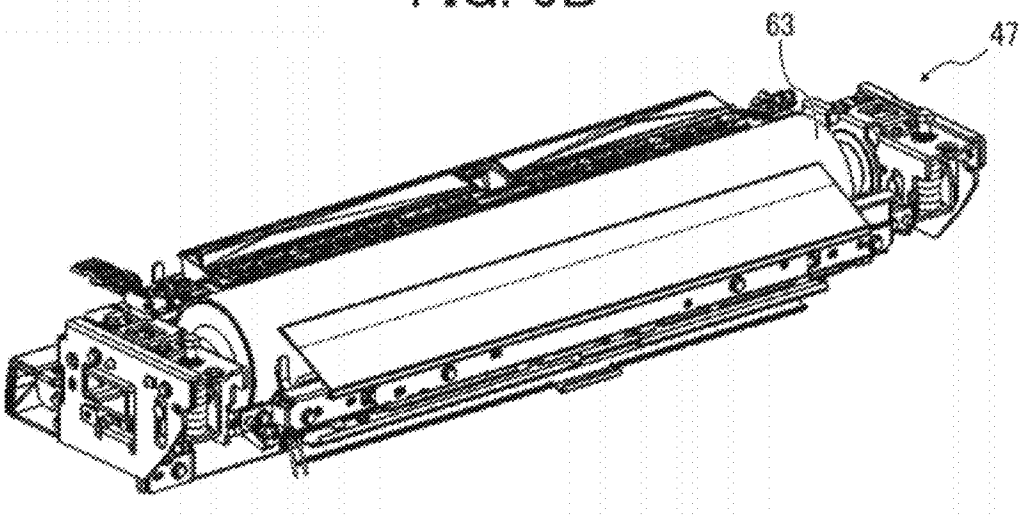
FIG. 5B is a perspective view of a pressing roller unit detached from the lower fixing unit shown in FIG. 5A.

FIG. 4A is a perspective view of the fixing device 6. FIG. 4B is a perspective view of a lower fixing unit 46 detached from the fixing device 6. FIG. 5A is a perspective view of the lower fixing unit 46 illustrating a shaft 48. FIG. 5B is a perspective view of a pressing roller unit 47 detached from the lower fixing unit 46. As shown in FIGS. 4A and 4B, the lower fixing unit 46, constituting a lower part of the fixing device 6, is detachably attached to the fixing device 6. The lower fixing unit 46 incorporates the pressing roller 63, the separation plate unit 66, and the components disposed opposite the pressing roller 63 as shown in FIG. 3A, that is, the sheet guide 84, the anti overheat assembly 85, the shield 86, the intake duct 68, the exhaust duct 69, the airflow guide 87, and the cleaner 83. As shown in FIGS. 5A and 5B, the pressing roller unit 47, constituting a part of the lower fixing unit 46, is detachably attached to the lower fixing unit 46. The pressing roller unit 47 incorporates the pressing roller 63 and the components disposed opposite the pressing roller 63 as shown in FIG. 3A excluding the intake duct 68 and the exhaust duct 69, that is, the sheet guide 84, the anti overheat assembly 85, the shield 86, the airflow guide 87, and the cleaner 83. As shown in FIG. 5A, the shaft 48, serving as a movable unit shaft, is attached to a frame of the pressing roller unit 47 to rotatably support the pressing roller unit 47 serving as a movable unit in such a manner that the pressing roller unit 47 is rotatable about the shaft 48 so that the pressing roller 63 of the pressing roller unit 47 contacts and separates from the fixing belt 64 depicted in FIG. 3A.

Figure 6A:
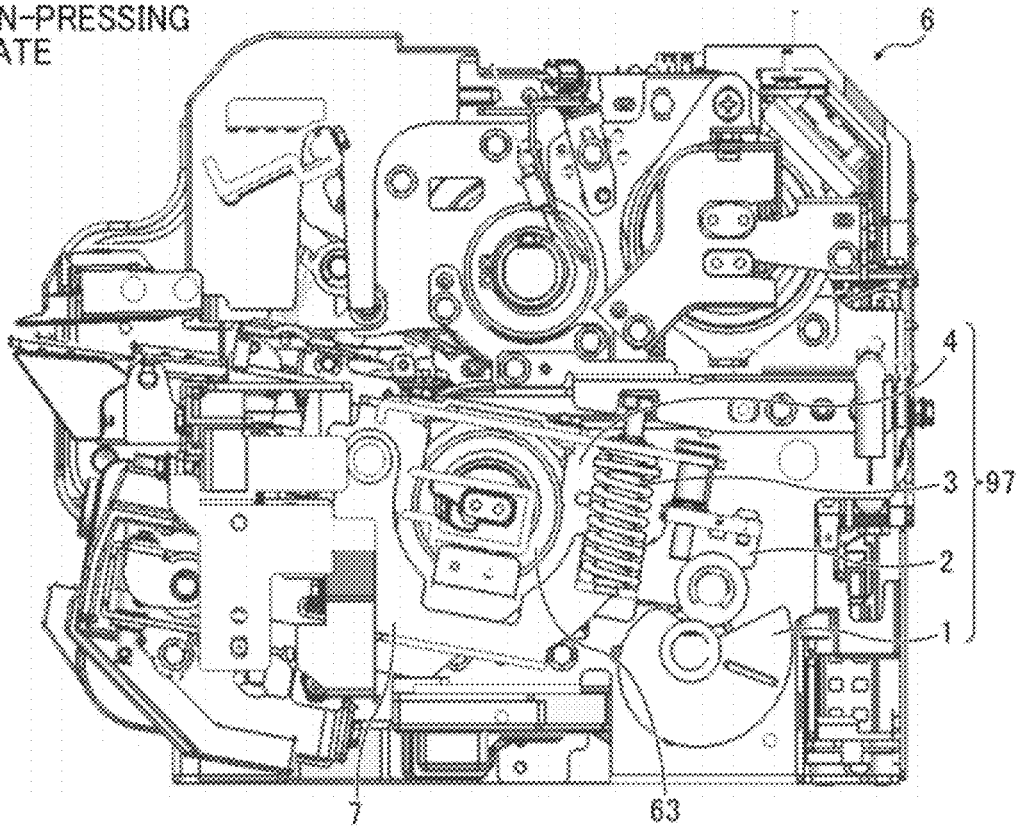
FIG. 6A is a vertical sectional view of the fixing device shown in FIG. 3A illustrating a moving assembly incorporated therein in a non-pressing state in which a pressing roller is isolated from a fixing belt.
Figure 6B:
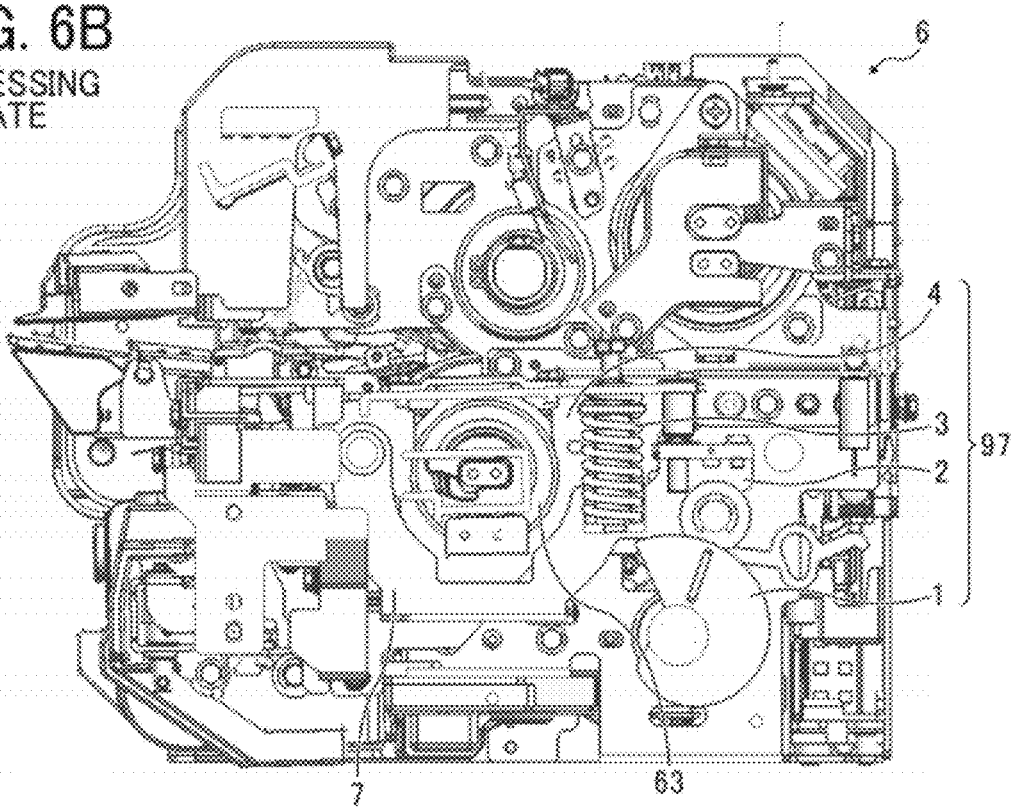
FIG. 6B is a vertical sectional view of the fixing device shown in FIG. 3A illustrating the moving assembly shown in FIG. 6A in a pressing state in which the pressing roller contacts the fixing belt.

Referring to FIGS. 6A and 6B, the following describes a moving assembly 97 that rotates or swings the pressing roller unit 47 about the shaft 48.

FIG. 6A is a vertical sectional view of the fixing device 6 illustrating the moving assembly 97 in a non-pressing state in which the pressing roller 63 is isolated from the fixing belt 64 depicted in FIG. 3A. FIG. 6B is a vertical sectional view of the fixing device 6 illustrating the moving assembly 97 in a pressing state in which the pressing roller 63 contacts the fixing belt 64. As shown in FIGS. 6A and 6B, the moving assembly 97 includes a cam 1, a pressing member 2 contacting the cam 1, a spring 3 mounted on the pressing member 2, and a pressing lever 4 attached with the spring 3 and in contact with the pressing roller 63.

As a driver rotates the cam 1 by a given angle from a non-pressing position shown in FIG. 6A to a pressing position shown in FIG. 6B, the cam 1 pushes up the pressing member 2. Accordingly, the spring 3 mounted on the pressing member 2 pushes up one end of the pressing lever 4, that is, a right end in FIGS. 6A and 6B, in a longitudinal direction of the pressing lever 4, rotating the pressing lever 4 counterclockwise in FIG. 6A about a support shaft that supports another end of the pressing lever 4 in the longitudinal direction thereof. Consequently, the pressing lever 4 contacting the pressing roller 63 pushes up the pressing roller 63, thus pressing the pressing roller 63 against the fixing belt 64 as shown in FIG. 6B illustrating the pressing state. Since the pressing lever 4 is connected to a frame 7 of the pressing roller unit 47, as the pressing lever 4 rotates, the pressing roller unit 47 rotates about the shaft 48 (depicted in FIG. 5A) constituting a part of the moving assembly 97. Accordingly, the cleaner 83, the sheet guide 84, the anti overheat assembly 85, the shield 86, and the airflow guide 87 (depicted in FIG. 3A) accommodated in the pressing roller unit 47 also move in accordance with movement of the pressing roller 63 caused by the moving assembly 97.

Figure 7:
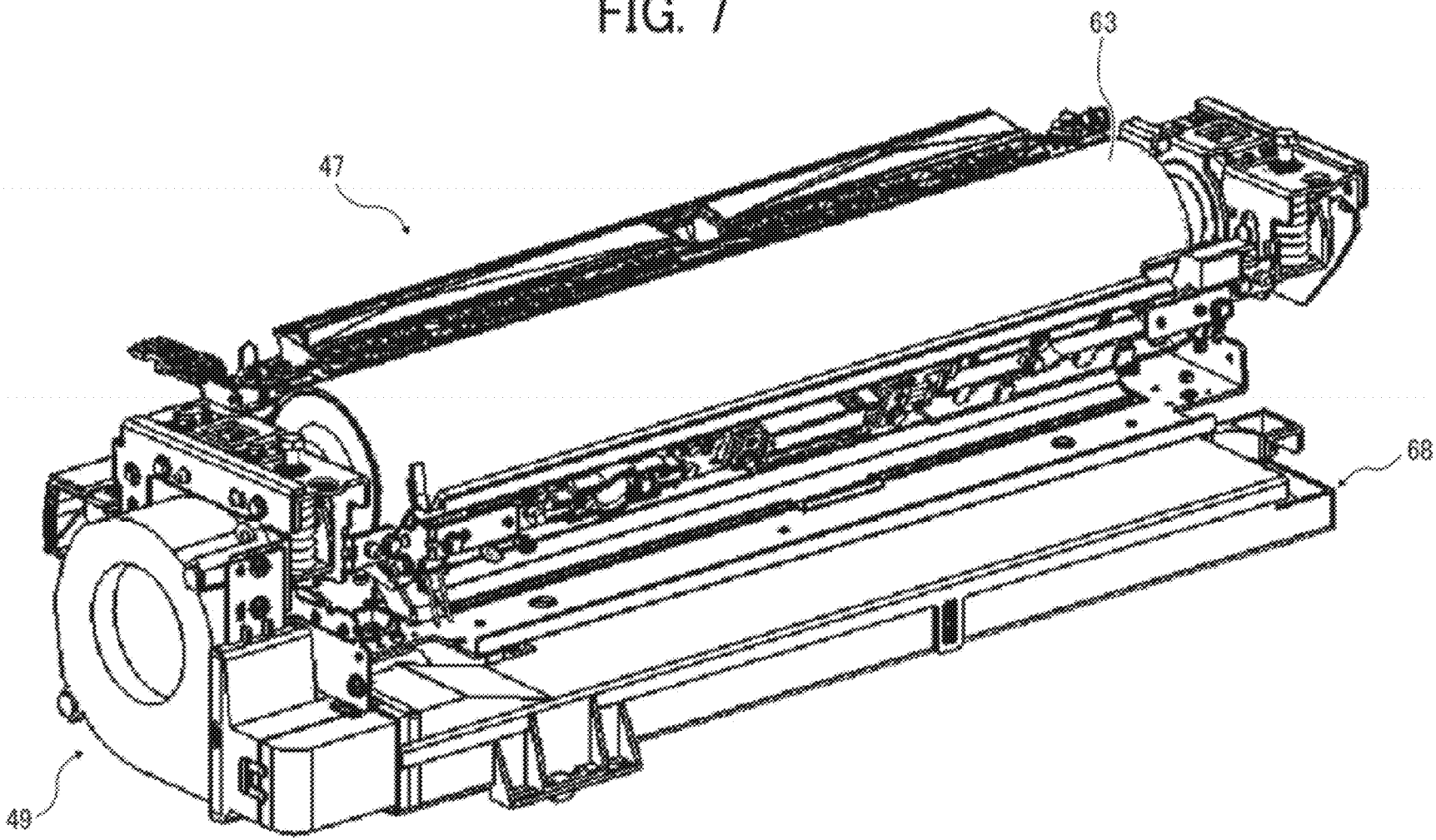
FIG. 7 is a perspective view of the pressing roller unit shown in FIG. 5B illustrating an axial fan attached thereto.
Figure 8A:
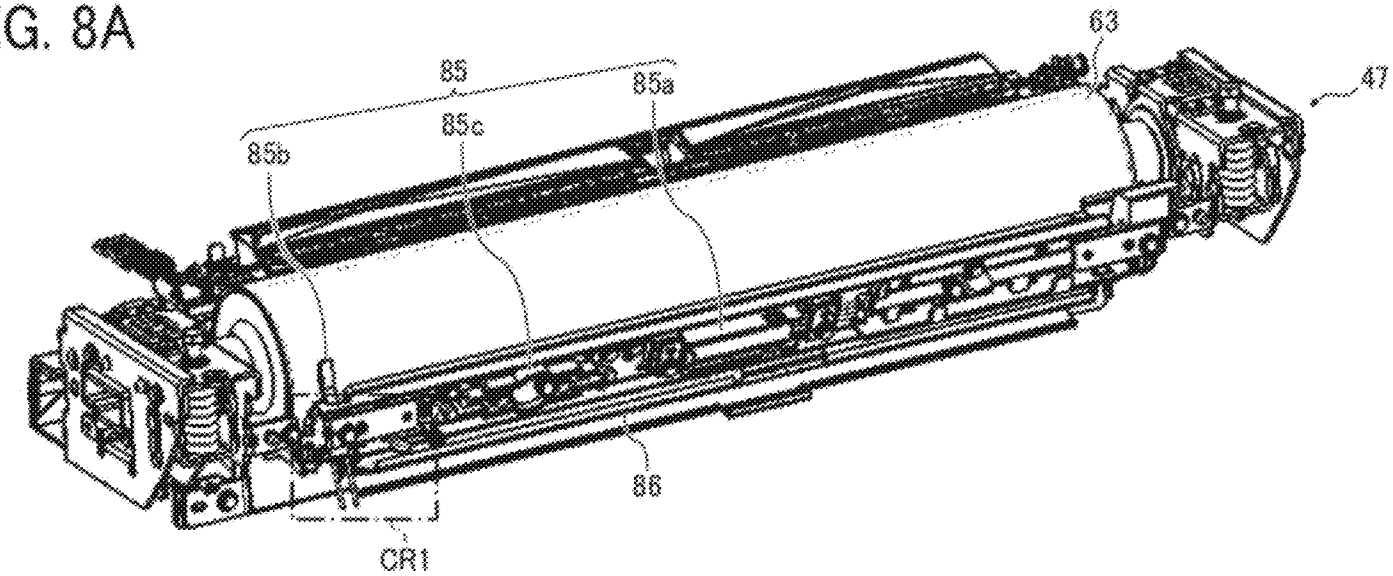
FIG. 8A is a perspective view of the pressing roller unit shown in FIG. 5B illustrating an anti overheat assembly incorporated therein.
Figure 8B:
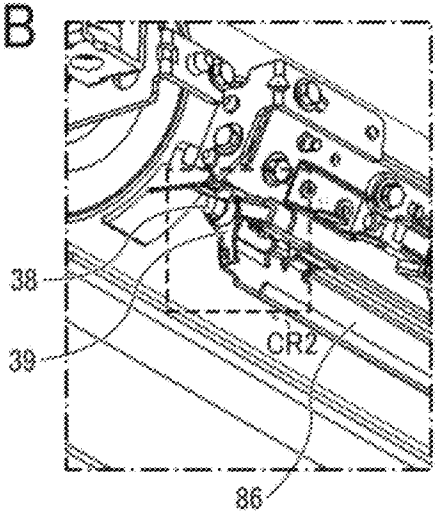
FIG. 8B is a partial perspective view of the pressing roller unit shown in FIG. 5B illustrating a shield incorporated therein.
Figure 8C:
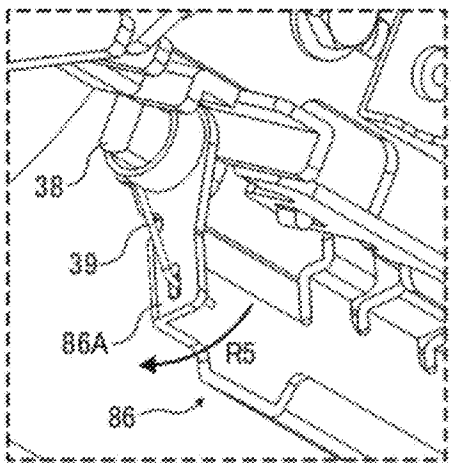
FIG. 8C is a perspective view of the shield shown in FIG. 8B.

FIG. 7 is a perspective view of the pressing roller unit 47 illustrating an axial fan 49. The axial fan 49 is connected to the intake duct 68 and serves as an airflow generator that generates airflow to be taken in by the intake duct 68 and impinge on the pressing roller 63. FIG. 8A is a perspective view of the pressing roller unit 47 illustrating the anti overheat assembly 85. FIG. 8B is a partial perspective view of the pressing roller unit 47 illustrating the shield 86. FIG. 8C is a perspective view of the shield 86. As shown in FIG. 8B illustrating a section of the pressing roller unit 47 enclosed by a dotted box CR1 in FIG. 8A and FIG. 8C illustrating a section of the pressing roller unit 47 enclosed by a dotted box CR2 in FIG. 8B, a rotation shaft 38 and a torsion spring 39 are attached to a lateral end flange 86A of the shield 86 in a longitudinal direction of the shield 86 parallel to a longitudinal direction of the pressing roller 63. For example, as shown in FIG. 8C, the rotation shaft 38 serving as a shield shaft rotatably supports the shield 86. The torsion spring 39 is attached to the lateral end flange 86A of the shield 86 and serves as a biasing member that biases the shield 86 in such a manner that the shield 86 rotates about the rotation shaft 38 in a rotation direction R5. With this configuration, the shield 86 is rotatably integrated into the pressing roller unit 47.

Referring back to FIG. 3A, the following describes the components incorporated in the fixing device 6 shown in FIG. 3A.

A detailed description is now given of the fixing belt 64.

The fixing belt 64 rotates in a rotation direction R2. The fixing belt 64 is constructed of a base layer having an inner loop diameter of about 80 mm and a thickness of about 90 micrometers and made of polyimide resin; an elastic layer coating the base layer, having a thickness of about 200 micrometers and made of silicone rubber; and an outer surface layer coating the elastic layer, having a thickness of about 20 micrometers and made of tetrafluoroethylene-perfluoroalkylvinylether copolymer (PFA).

A detailed description is now given of the heating roller 62.

The heating roller 62 rotates in a rotation direction R4. The heating roller 62 is constructed of a hollow aluminum cylinder having an outer diameter of about 40 mm and a thickness not greater than about 1 mm. A halogen heater 62*a* serving as a heater that heats the heating roller 62 is disposed inside the heating roller 62.

A detailed description is now given of the fixing roller 65.

The fixing roller 65 rotates in a rotation direction R3. The fixing roller 65 is constructed of a tubular heat resistant elastic layer having an outer diameter of about 54 mm and a thickness of about 15 mm and made of silicone rubber or fluororubber.

A detailed description is now given of the pressing roller 63.

The pressing roller 63 rotates in the rotation direction R1 and has an outer diameter of about 65 mm. The pressing roller 63 is constructed of a hollow metal core having a thickness of about 1 mm and made of steel; an elastic layer coating the hollow metal core, having a thickness of about 1.5 mm and made of silicone rubber; and a tubular outer surface layer coating the elastic layer and made of PFA. A halogen heater 63*a* serving as a heater that heats the pressing roller 63 is disposed inside the pressing roller 63. The pressing roller 63 is pressed against the fixing roller 65 in such a manner that the pressing roller 63 is engaged in the fixing roller 65 via the fixing belt 64 by about 4 mm, thus forming the fixing nip 61 having a length of about 16 mm in the rotation direction R1 of the pressing roller 63.

A detailed description is now given of the anti overheat assembly 85.

As shown in FIG. 8A, the anti overheat assembly 85 includes a non-contact temperature sensor 85*a* disposed opposite a center of the pressing roller 63 in the longitudinal direction, that is, an axial direction, of the pressing roller 63 without contacting the pressing roller 63; a thermistor 85*b* disposed opposite and contacting one end of the pressing roller 63 in the longitudinal direction thereof; and a thermostat 85*c* interposed between the non-contact temperature sensor 85*a* and the thermistor 85*b* in the longitudinal direction of the pressing roller 63. The non-contact temperature sensor 85*a* serves as a first temperature detector that detects the temperature of a center, that is, a sheet conveyance region, on the outer circumferential surface of the pressing roller 63 in the longitudinal direction thereof through which the sheet P is conveyed. By contrast, the thermistor 85*b* serves as a second temperature detector that detects the temperature of one end on the outer circumferential surface of the pressing roller 63 in the longitudinal direction thereof through which the sheet P is not conveyed. The thermostat 85*c* serves as an anti overheat member that prevents overheating of the pressing roller 63.

The controller 99 depicted in FIG. 1, operatively connected to the non-contact temperature sensor 85*a* and the thermistor 85*b*, controls the halogen heater 63*a* depicted in FIG. 3A based on the temperature of the pressing roller 63 detected by the non-contact temperature sensor 85*a* and the thermistor 85*b* to heat the pressing roller 63 to a given temperature range. Thus, the non-contact temperature sensor 85*a* and the thermistor 85*b* constitute the anti overheat assembly 85 that prevents overheating of the pressing roller 63. The thermostat 85*c* itself adjusts the temperature of the pressing roller 63 to a given temperature range, also constituting the anti overheat assembly 85 that prevents overheating of the pressing roller 63.

With the above-described configuration of the fixing device 6, as the sheet P guided by the sheet guide 84 is conveyed through the fixing nip 61 in the sheet conveyance direction D1, the fixing belt 64 heated by the halogen heater 62*a* via the heating roller 62 and the pressing roller 63 heated by the halogen heater 63*a* apply heat and pressure to the sheet P, thus fixing the toner image T on the sheet P. As the sheet P is conveyed through the fixing nip 61, the fixing belt 64 contacts one side, that is, the front side, of the sheet P that bears the unfixed toner image T. Conversely, the pressing roller 63 contacts another side, that is, the back side, of the sheet P that does not bear the unfixed toner image T or bears the fixed toner image T during duplex printing.

In order to form the high quality toner image T on the sheet P, it is requested to maintain the temperature of the fixing nip 61 to an appropriate fixing temperature. To address this request, the anti overheat assembly 85 maintains the appropriate fixing temperature of the fixing nip 61. However, during duplex printing, the pressing roller 63 is subject to overheat, causing a temperature differential between the temperature of the front side of the sheet P that contacts the fixing belt 64 and the temperature of the back side of the sheet P that contacts the pressing roller 63. Accordingly, a gloss differential may arise between the toner image T on the front side of the sheet P and the toner image T on the back side of the sheet P or slight surface scratches on the outer circumferential surface of the pressing roller 63 may damage the toner image T on the sheet P. Consequently, the faulty toner image T is formed on the sheet P. When glossy paper or coated paper is used in the image forming apparatus 100, it is susceptible to those failures. In order to minimize those failures, the fixing device 6 performs a cooling operation below to decrease the temperature of the pressing roller 63.

For example, the axial fan 49 depicted in FIG. 7 generates airflow that cools the pressing roller 63. The airflow travels through the intake duct 68 and impinges on the outer circumferential surface of the pressing roller 63, thus cooling the pressing roller 63 and therefore preventing overheating of the pressing roller 63.

The cooling operation described above starts when the temperature of the pressing roller 63 detected by the non-contact temperature sensor 85*a* depicted in FIG. 8A is a first temperature or higher. When the temperature of the pressing roller 63 detected by the non-contact temperature sensor 85*a* is a second temperature or higher that is higher than the first temperature, the pressing roller unit 47 swings about the shaft 48 depicted in FIG. 5A from a contact position, that is, a first position or a pressing position, where the pressing roller 63 of the pressing roller unit 47 contacts the fixing belt 64 depicted in FIG. 3A to an isolation position, that is, a second position or a non-pressing position, where the pressing roller 63 is isolated from the fixing belt 64. When the pressing roller unit 47 is at the isolation position, the cooling operation described above starts. When the temperature of the pressing roller 63 detected by the non-contact temperature sensor 85*a* is lower than the second temperature, the pressing roller unit 47 swings about the shaft 48 from the isolation position to the contact position. Thus, the pressing roller 63 comes in contact with the fixing belt 64. The controller 99 depicted in FIG. 1, operatively connected to the moving assembly 97 depicted in FIGS. 6A and 6B, controls the moving assembly 97 to move the pressing roller unit 47 between the contact position and the isolation position based on the temperature of the pressing roller 63 detected by the non-contact temperature sensor 85*a* and the thermistor 85*b*.

The controller 99 controls driving of the axial fan 49 depicted in FIG. 7 based on the temperature of the center of the pressing roller 63 in the longitudinal direction thereof detected by the non-contact temperature sensor 85*a* and the temperature of one end of the pressing roller 63 in the longitudinal direction thereof detected by the thermistor 85*b*. That is, the controller 99 controls cooling of the pressing roller 63 performed by the axial fan 49.

For example, the controller 99 increases the strength of airflow, that is, an amount of air supplied by the axial fan 49 to the pressing roller 63 when the temperature of the pressing roller 63 detected by the non-contact temperature sensor 85*a* and the thermistor 85*b* is relatively high. Accordingly, energy to drive the axial fan 49 is used efficiently to cool the pressing roller 63 effectively, maintaining the temperature of the pressing roller 63 at an appropriate temperature. Further, with the thermistor 85*b* that detects the temperature of one end of the pressing roller 63 through which the sheet P is not conveyed, even after a plurality of sheets P is conveyed through the fixing nip 61 continuously, the controller 99 controls the temperature of the pressing roller 63 properly, preventing overheating of both lateral ends of the pressing roller 63 in the longitudinal direction thereof due to absence of the sheets P that draw heat therefrom. Hence, even when a larger sheet P that extends beyond the center to both lateral ends of the pressing roller 63 in the longitudinal direction thereof is conveyed through the fixing nip 61, the larger sheet P is heated uniformly throughout the entire width in the longitudinal direction of the pressing roller 63.

When the image forming apparatus 100 is in a standby mode in which the image forming apparatus 100 waits for a print job, the moving assembly 97 depicted in FIG. 6B moves the pressing roller unit 47 to the isolation position where the pressing roller 63 is isolated from the fixing belt 64. Since the intake duct 68 and the exhaust duct 69 are not mounted on the pressing roller unit 47, they are stationary regardless of whether the pressing roller unit 47 is at the contact position or the isolation position.

Whether the pressing roller unit 47 is at the contact position or the isolation position, when airflow generated by the axial fan 49 leaks from an interval between the pressing roller 63 and the intake duct 68 or between the pressing roller 63 and the exhaust duct 69 to the components other than the pressing roller 63, airflow may impinge on the pressing roller 63 ineffectively, degrading cooling efficiency to cool the pressing roller 63. Further, airflow heated by the pressing roller 63 may move through the interval between the pressing roller 63 and the intake duct 68 and between the pressing roller 63 and the exhaust duct 69 to the components other than the pressing roller 63 inside the fixing device 6 and farther to the components outside the fixing device 6 in the body 101, overheating those components and thereby causing failures such as coagulation of toner that may adversely affect operation of the entire image forming apparatus 100 and deterioration in accuracy of detection of the non-contact temperature sensor 85*a* and the thermistor 85*b* that may result in deterioration in accuracy of controlling the temperature of the pressing roller 63.

Figure 9A:
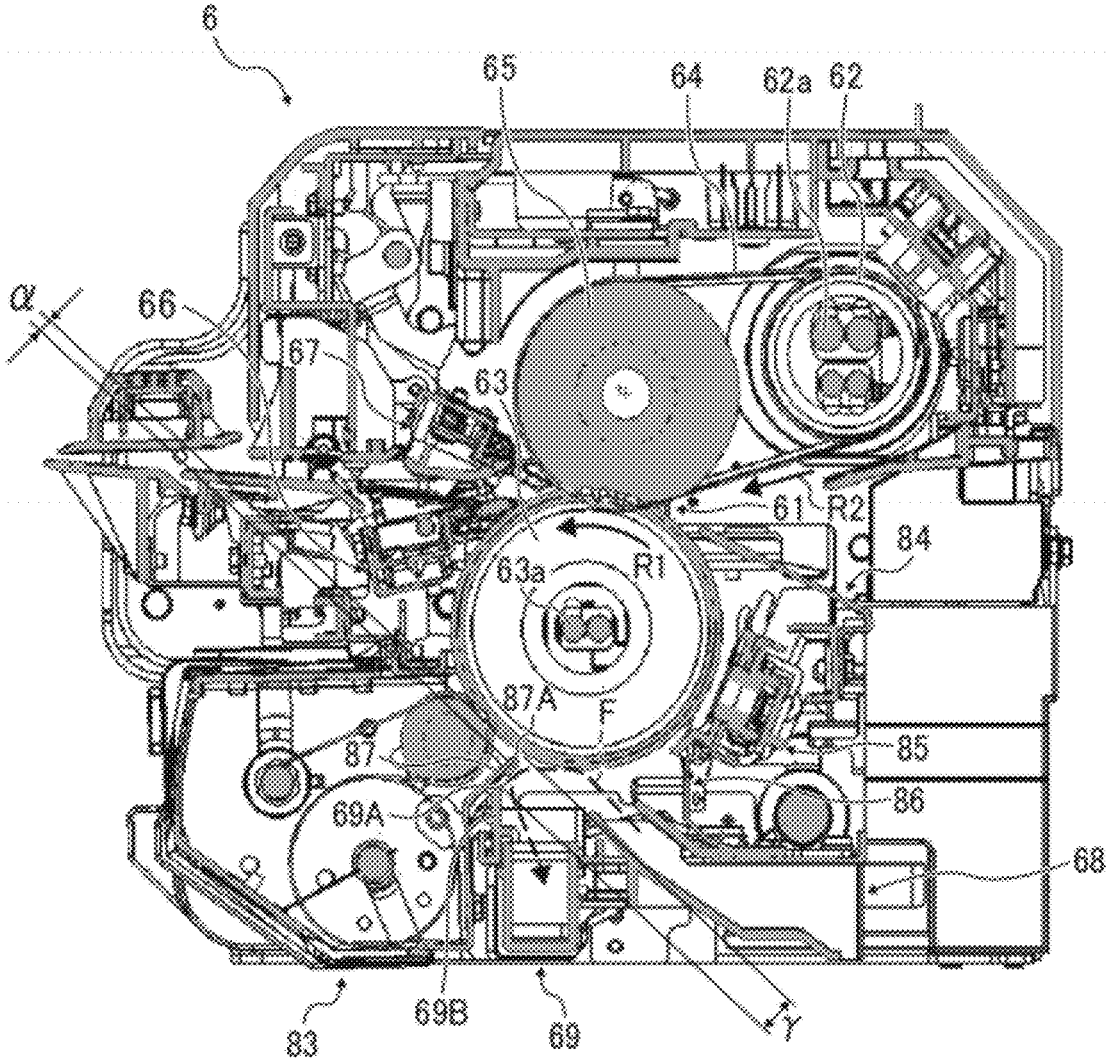
FIG. 9A is a vertical sectional view of the fixing device shown in FIG. 3A in the pressing state in which the pressing roller contacts the fixing belt.
Figure 9B:
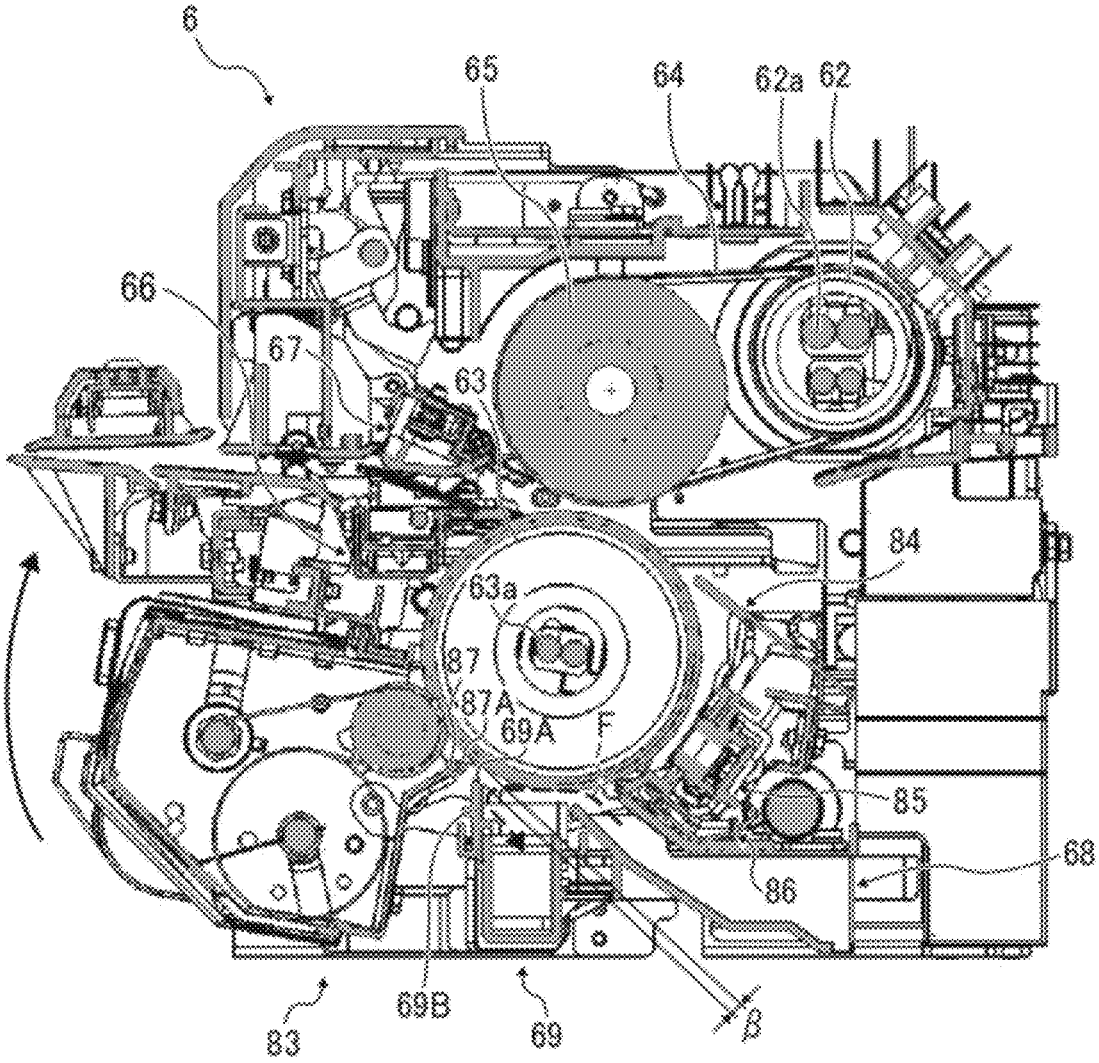
FIG. 9B is a vertical sectional view of the fixing device shown in FIG. 3A in the non-pressing state in which the pressing roller is isolated from the fixing belt.

To address these problems, the airflow guide 87 is disposed opposite the pressing roller 63 with a constant interval interposed therebetween as shown in FIGS. 9A and 9B. FIG. 9A is a vertical sectional view of the fixing device 6 in the pressing state in which the pressing roller 63 contacts the fixing belt 64. FIG. 9B is a vertical sectional view of the fixing device 6 in the non-pressing state in which the pressing roller 63 is isolated from the fixing belt 64. As shown in FIG. 9A, the airflow guide 87 is attached to the cleaner 83 mounted on the frame 7 of the swingable pressing roller unit 47 depicted in FIGS. 5B and 6A. An interval α, that is, a gap, is provided between the outer circumferential surface of the pressing roller 63 and an opposed face 87A of the airflow guide 87 disposed opposite the pressing roller 63. Since the airflow guide 87 is accommodated in the pressing roller unit 47, the airflow guide 87 moves in accordance with movement of the pressing roller 63 accommodated in the pressing roller unit 47 between the contact position where the pressing roller 63 contacts the fixing belt 64 and the isolation position where the pressing roller 63 is isolated from the fixing belt 64. Accordingly, regardless of whether the pressing roller 63 is at the contact position shown in FIG. 9A or at the isolation position shown in FIG. 9B, the interval α is constant. The interval α defines a distance that prohibits leakage of airflow F blown from the intake duct 68 and impinging on the pressing roller 63 from the interval between the airflow guide 87 and the pressing roller 63 into the cleaner 83 or a distance that prevents occurrence of the problems described above even if airflow F leaks from the interval between the airflow guide 87 and the pressing roller 63.

As shown in FIG. 9A, the airflow guide 87 guides airflow F impinging on the pressing roller 63 from the intake duct 68 and reflected by the pressing roller 63 to the exhaust duct 69 in the pressing state in which the pressing roller 63 is at the contact position where it contacts the fixing belt 64. For example, in the pressing state shown in FIG. 9A, an interval γ is provided between the outer circumferential surface of the pressing roller 63 and an opposed face 69A of a guide wall 69B of the exhaust duct 69 disposed opposite the pressing roller 63. Since the interval γ is greater than the interval α, the airflow guide 87 protrudes beyond the guide wall 69B of the exhaust duct 69 toward the pressing roller 63, guiding airflow F reflected by the pressing roller 63 to the exhaust duct 69. Conversely, in the non-pressing state shown in FIG. 9B in which the pressing roller 63 is at the isolation position where it is isolated from the fixing belt 64, the pressing roller 63 is closer to the exhaust duct 69. Since the airflow guide 87 and the pressing roller 63 are accommodated in the pressing roller unit 47, the interval α between the pressing roller 63 and the airflow guide 87 is constant. By contrast, the interval γ between the pressing roller 63 and the guide wall 69B is variable because the exhaust duct 69 is not accommodated in the pressing roller unit 47 but is stationarily mounted on the frame of the fixing device 6. Accordingly, in the non-pressing state, an interval β equivalent to the interval α is provided between the pressing roller 63 and the guide wall 69B and therefore the airflow guide 87 retreats from an airflow path through which airflow F reflected by the pressing roller 63 travels to the exhaust duct 69. Instead, the guide wall 69B of the stationary exhaust duct 69 guides airflow F impinging on the pressing roller 63 from the intake duct 68 and reflected by the pressing roller 63 to the exhaust duct 69 on behalf of the airflow guide 87.

In the non-pressing state shown in FIG. 9B, the interval β defines a gap between the outer circumferential surface of the pressing roller 63 and the opposed face 69A of the guide wall 69B of the exhaust duct 69. The interval β is equivalent to the interval α between the pressing roller 63 and the airflow guide 87. Similar to the interval α, the interval β defines a distance that prohibits leakage of airflow F blown from the intake duct 68 and impinging on the pressing roller 63 from the interval between the opposed face 69A of the guide wall 69B of the exhaust duct 69 and the pressing roller 63 into the cleaner 83 or a distance that prevents occurrence of the problems described above even if airflow F leaks from the interval between the opposed face 69A of the guide wall 69B of the exhaust duct 69 and the pressing roller 63.

Both in the pressing state and the non-pressing state, the shield 86 is interposed between an outlet of the intake duct 68 and the anti overheat assembly 85 in the rotation direction R1 of the pressing roller 63 to block airflow F generated by the axial fan 49 depicted in FIG. 7 and blown from the intake duct 68, thus shielding the anti overheat assembly 85 against airflow F.

For example, as shown in FIG. 8C, the shield 86 includes the lateral end flange 86A rotatably supported by the rotation shaft 38 attached to the frame 7 of the pressing roller unit 47. The torsion spring 39 exerts a bias to the lateral end flange 86A, which applies a moment that rotates the lateral end flange 86A in the rotation direction R5. Accordingly, the lateral end flange 86A and a free end 86B of the shield 86 strike and come in elastic contact with a top face 68A of the intake duct 68 as shown in FIGS. 10A to 10D. FIG. 10A is a vertical sectional view of the fixing device 6 in the pressing state. FIG. 10B is an enlarged vertical sectional view of the components enclosed by the dotted box in FIG. 10A. FIG. 10C is a vertical sectional view of the fixing device 6 in the non-pressing state. FIG. 10D is an enlarged vertical sectional view of the components enclosed by the dotted box in FIG. 10C.

As the moving assembly 97 depicted in FIG. 6A swings or rotates the pressing roller unit 47 about the shaft 48 depicted in FIG. 5A to move the pressing roller 63 from the contact position shown in FIG. 10A to the isolation position shown in FIG. 10B and therefore the rotation shaft 38 depicted in FIG. 8C moves in accordance with movement of the pressing roller 63 accommodated in the rotating pressing roller unit 47, a contact state in which the shield 86 contacts the top face 68A of the intake duct 68 changes between the pressing state and the non-pressing state as shown in FIGS. 10B and 10D. However, although the shield 86 rotates about the rotation shaft 38, the shield 86 constantly contacts the top face 68A of the intake duct 68. That is, as the moving assembly 97 moves the pressing roller 63 from the contact position shown in FIG. 10A to the isolation position shown in FIG. 10B and vice versa, the shield 86 also moves in accordance with movement of the pressing roller 63 while the shield 86 shields the anti overheat assembly 85 against airflow generated by the axial fan 49.

With the configuration of the fixing device 6 described above, airflow generated by the axial fan 49 is blown from the intake duct 68, impinges on the pressing roller 63 to cool it, and enters the exhaust duct 69. The airflow path through which airflow F blown from the intake duct 68 travels to the exhaust duct 69 in an airflow direction substantially counter to the rotation direction R1 of the pressing roller 63 is provided with the shield 86 disposed at an upstream position in the airflow direction and the airflow guide 87 and the exhaust duct 69 disposed at a downstream position in the airflow direction. Accordingly, in the pressing state shown in FIG. 9A, the shield 86 disposed at the upstream position in the airflow direction blocks airflow F blown from the intake duct 68 to shield the anti overheat assembly 85 and the airflow guide 87 blocks airflow F moving toward the cleaner 83 to shield the cleaner 83. Similarly, in the non-pressing state shown in FIG. 9B, the shield 86 blocks airflow F blown from the intake duct 68 to shield the anti overheat assembly 85 and the guide wall 69B of the exhaust duct 69 blocks airflow F moving toward the cleaner 83 to shield the cleaner 83.

Accordingly, both in the pressing state and the non-pressing state, airflow generated by the axial fan 49 does not move through the interval between the intake duct 68 and the pressing roller 63 to the anti overheat assembly 85 and through the interval between the exhaust duct 69 and the pressing roller 63 to the cleaner 83, thus cooling the pressing roller 63 effectively. Simultaneously, airflow heated by the pressing roller 63 does not diffuse to and overheat other components incorporated in the fixing device 6 and the components incorporated in the body 101 depicted in FIG. 1 other than the fixing device 6, preventing failures such as coagulation of toner that may adversely affect operation of the entire image forming apparatus 100 and deterioration in accuracy of detection of the non-contact temperature sensor 85*a* and the thermistor 85*b* depicted in FIG. 8A that may result in deterioration in accuracy of controlling the temperature of the pressing roller 63.

The interval α between the pressing roller 63 and the opposed face 87A of the airflow guide 87 and the interval β between the pressing roller 63 and the opposed face 69A of the guide wall 69B of the exhaust duct 69 are created in accordance with movement of the pressing roller 63. Accordingly, the airflow guide 87 and the guide wall 69B of the exhaust duct 69 block airflow precisely with the simple configuration that creates the intervals α and β at reduced manufacturing costs. The shield 86 is attached with the rotation shaft 38 and the torsion spring 39 serving as a linkage that allows movement of the shield 86 in accordance with movement of the pressing roller 63 and also serving as an engagement mechanism that causes the shield 86 to constantly contact the top face 68A of the intake duct 68 so that the shield 86 constantly shields the anti overheat assembly 85 against airflow from the intake duct 68 regardless of movement of the pressing roller 63. In other words, no extra sensor and motor are used to block airflow. Thus, the shield 86 shields the anti overheat assembly 85 against airflow precisely with the simple configuration that constantly blocks airflow at reduced manufacturing costs. It is to be noted that the intake duct 68 and the exhaust duct 69 are situated with no interval therebetween through which airflow leaks.

The following describes advantages of the fixing device 6 according to the example embodiments described above.

As shown in FIG. 3A, the fixing device 6 includes the fixing belt 64 serving as a first rotary body, the pressing roller 63 serving as a second rotary body, the axial fan 49 serving as an airflow generator depicted in FIG. 7, the intake duct 68, the exhaust duct 69, the moving assembly 97 depicted in FIG. 6A, and the airflow guide 87. For example, the fixing belt 64 is the first rotary body that is rotatable in the rotation direction R2 and in contact with one side of a sheet P that bears an unfixed toner image T as the sheet P is conveyed through the fixing nip 61. The pressing roller 63 is the second rotary body that is rotatable in the rotation direction R1 counter to the rotation direction R2 of the fixing belt 64 and in contact with another side of the sheet P. The axial fan 49 is the airflow generator that generates airflow to cool the pressing roller 63. The intake duct 68 constitutes a first airflow path through which airflow generated by the axial fan 49 travels to the pressing roller 63. The exhaust duct 69 constitutes a second airflow path through which airflow reflected by the pressing roller 63 travels. The moving assembly 97 connected to the pressing roller 63 moves the pressing roller 63 between a first position where the pressing roller 63 contacts the fixing belt 64 and a second position where the pressing roller 63 is isolated from the fixing belt 64.

As shown in FIG. 9A, when the pressing roller 63 is at the first position, the airflow guide 87 guides airflow F reflected by the pressing roller 63 to the exhaust duct 69. As shown in FIG. 9B, when the pressing roller 63 is at the second position, the airflow guide 87 retreats from a third airflow path extending from the pressing roller 63 to the exhaust duct 69. The constant interval α is provided between the outer circumferential surface of the pressing roller 63 and the opposed face 87A of the airflow guide 87 disposed opposite the pressing roller 63 when the pressing roller 63 is at the first position and the second position. The interval β equivalent to the interval α is provided between the outer circumferential surface of the pressing roller 63 and the opposed face 69A of the guide wall 69B of the exhaust duct 69. The airflow guide 87 guides airflow F reflected by the pressing roller 63 to the exhaust duct 69 and minimizes leakage of airflow F to the components other than the exhaust duct 69, facilitating cooling of the pressing roller 63 by airflow F without complicating the structure of the pressing roller 63 and minimizing failures of the components other than the pressing roller 63 that may arise due to leakage airflow. Hence, the pressing roller 63 is cooled by airflow F stably, resulting in formation of a high quality toner image.

As shown in FIG. 3A, the fixing device 6 further includes the anti overheat assembly 85 and the shield 86. For example, the anti overheat assembly 85 is disposed opposite the outer circumferential surface of the pressing roller 63 to detect the temperature of the pressing roller 63. The controller 99 depicted in FIG. 1 is operatively connected to the anti overheat assembly 85 to adjust the temperature of the pressing roller 63 based on the temperature detected by the anti overheat assembly 85, thus preventing overheating of the pressing roller 63. The shield 86 is interposed between the intake duct 68 and the anti overheat assembly 85 in the rotation direction R1 of the pressing roller 63 to shield the anti overheat assembly 85 against airflow blown from the intake duct 68. Accordingly, the shield 86 facilitates precise detection of the temperature of the pressing roller 63 by the anti overheat assembly 85. Consequently, the fixing device 6 fixes a high quality toner image on the sheet P safely.

The moving assembly 97 depicted in FIG. 6A moves the pressing roller 63 to cause the pressing roller 63 to contact the fixing belt 64 at the first position and separate from the fixing belt 64 at the second position. Since the pressing roller 63 and the shield 86 are accommodated in the movable pressing roller unit 47 depicted in FIG. 5B, the shield 86 moves in accordance with movement of the pressing roller 63 in a state in which the shield 86 is constantly in contact with the intake duct 68 to shield the anti overheat assembly 85 against airflow from the intake duct 68. Hence, the shield 86 constantly blocks airflow both when the pressing roller 63 is at the first position where the pressing roller 63 contacts the fixing belt 64 and when the pressing roller 63 is at the second position where the pressing roller 63 is isolated from the fixing belt 64. Accordingly, the shield 86 facilitates precise detection of the temperature of the pressing roller 63 by the anti overheat assembly 85. Consequently, the fixing device 6 fixes a high quality toner image on the sheet P safely.

As shown in FIG. 8C, the shield 86 is rotatably supported by the rotation shaft 38 serving as a shield shaft accommodated in the movable pressing roller unit 47. Accordingly, as the movable pressing roller unit 47 swings, the rotation shaft 38 and the shield 86 move in accordance with movement of the pressing roller 63. The torsion spring 39 serving as a biasing member is attached to the shield 86 to exert a bias that rotates the shield 86 about the rotation shaft 38 in the rotation direction R5, bringing the shield 86 into constant contact with the top face 68A of the intake duct 68 as shown in FIGS. 10B and 10D. As the moving assembly 97 moves the pressing roller 63 from the first position to the second position and vice versa, the shield 86 slides over the top face 68A of the intake duct 68 in a state in which the shield 86 constantly contacts the top face 68A of the intake duct 68. Hence, the shield 86 constantly shields the anti overheat assembly 85 against airflow from the intake duct 68. Accordingly, the shield 86 constantly blocks airflow with the simple structure manufactured at reduced costs whether the pressing roller 63 is at the first position or the second position. Consequently, the shield 86 facilitates precise detection of the temperature of the pressing roller 63 by the anti overheat assembly 85 and thus the fixing device 6 fixes a high quality toner image on the sheet P safely.

As shown in FIG. 8A, the anti overheat assembly 85 includes the non-contact temperature sensor 85*a* serving as a first temperature detector disposed opposite the outer circumferential surface of the pressing roller 63 to detect the temperature of the pressing roller 63. The controller 99 depicted in FIG. 1 is operatively connected to the non-contact temperature sensor 85*a* and the axial fan 49 depicted in FIG. 7 to adjust the amount of airflow generated by the axial fan 49 based on the temperature of the pressing roller 63 detected by the non-contact temperature sensor 85*a*, cooling the pressing roller 63 by the adjusted amount of airflow and thus preventing overheating of the pressing roller 63. That is, the pressing roller 63 is cooled by the amount of airflow adjusted based on the temperature of the pressing roller 63 detected by the non-contact temperature sensor 85*a* as needed. Hence, the fixing device 6 fixes a high quality toner image on the sheet P precisely.

As shown in FIG. 8A, the anti overheat assembly 85 further includes the thermistor 85*b* serving as a second temperature detector disposed opposite one end on the outer circumferential surface of the pressing roller 63 in the axial direction thereof to detect the temperature of the one end of the pressing roller 63. The controller 99 depicted in FIG. 1 is operatively connected to the thermistor 85*b* and the axial fan 49 depicted in FIG. 7 to adjust the amount of airflow generated by the axial fan 49 based on the temperature of the one end of the pressing roller 63 detected by the thermistor 85*b*, cooling the pressing roller 63 by the adjusted amount of airflow and thus preventing overheating of the pressing roller 63. That is, the pressing roller 63 is cooled by the amount of airflow adjusted based on the temperature of the pressing roller 63 detected by the thermistor 85*b* as needed. Hence, even if a plurality of small sheets P is conveyed through the fixing nip 61 continuously and therefore both lateral ends of the pressing roller 63 in the axial direction thereof are overheated due to absence of the sheets P that draw heat therefrom, the precise amount of airflow is supplied to the pressing roller 63 to cool the overheated lateral ends of the pressing roller 63. As a result, the fixing device 6 fixes a high quality toner image on the sheet P precisely.

The fixing device 6 that attains the advantages described above is installed in the image forming apparatus 100. Thus, the image forming apparatus 100 forms a high quality toner image on the sheet P precisely.

The present invention is not limited to the details of the example embodiments described above, and various modifications and improvements are possible.

For example, according to the example embodiments described above, the fixing belt 64 serves as a first rotary body. Alternatively, the first rotary body may be a roller (e.g., a fixing roller). According to the example embodiments described above, the pressing roller 63 serves as a second rotary body. Alternatively, the second rotary body may be a belt (e.g., a pressing belt).

According to the example embodiments described above, the image forming apparatus 100 incorporates the intermediate transfer belt 11 serving as an intermediate transferor that transfers the yellow, magenta, cyan, and black toner images from the photoconductive drums 20Y, 20M, 20C, and 20K onto the sheet P indirectly. Alternatively, the image forming apparatus 100 may employ a direct transfer method eliminating the intermediate transferor in which the yellow, magenta, cyan, and black toner images are directly transferred from the photoconductive drums 20Y, 20M, 20C, and 20K onto the sheet P. Further, the image forming apparatus 100 is a multifunction printer that forms color and monochrome toner images on the sheet P. Alternatively, the image forming apparatus 100 may be a monochrome image forming apparatus. The image forming apparatus 100 uses the two-component developer that contains toner particles and magnetic carrier particles. Alternatively, the image forming apparatus 100 may use a single component developer that contains toner particles only.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device comprising:

a first rotary body rotatable in a predetermined direction of rotation;

a movable unit disposed opposite the first rotary body and movable with respect to the first rotary body, the movable unit including:

a second rotary body rotatable in a direction counter to the direction of rotation of the first rotary body; and an airflow guide spaced apart from an outer circumferential surface of the second rotary body with a constant first interval therebetween;

an airflow generator to generate airflow;

an intake duct, disposed opposite the outer circumferential surface of the second rotary body, through which the airflow generated by the airflow generator impinges on the outer circumferential surface of the second rotary body;

an exhaust duct disposed opposite the outer circumferential surface of the second rotary body and interposed between the airflow guide and the intake duct in the direction of rotation of the second rotary body, the exhaust duct through which the airflow reflected by the second rotary body travels and including a guide wall spaced apart from the outer circumferential surface of the second rotary body with a variable second interval therebetween; and a moving assembly connected to the movable unit to move the second rotary body and the airflow guide between a first position and a second position, the first position where the second rotary body contacts the first rotary body to form a fixing nip therebetween through which a recording medium bearing an unfixed toner image is conveyed and the constant first interval is smaller than the variable second interval to cause the airflow guide to guide the airflow reflected by the second rotary body to the exhaust duct, the second position where the second rotary body is isolated from the first rotary body and the constant first interval is equivalent to the variable second interval to cause the guide wall of the exhaust duct to guide the airflow reflected by the second rotary body to the exhaust duct.

2. The fixing device according to claim 1, further comprising:

an anti overheat assembly disposed opposite the outer circumferential surface of the second rotary body to detect a temperature of the second rotary body; and a shield interposed between the intake duct and the anti overheat assembly in the direction of rotation of the second rotary body to shield the anti overheat assembly against the airflow from the intake duct.

3. The fixing device according to claim 2, wherein the shield is accommodated in the movable unit, and wherein as the moving assembly moves the movable unit to move the second rotary body between the first position and the second position, the shield moves in accordance with movement of the second rotary body in a state in which the shield constantly contacts the intake duct.

4. The fixing device according to claim 3, further comprising:

a shield shaft accommodated in the movable unit to rotatably support the shield; and a biasing member attached to the shield to exert a bias that rotates the shield about the shield shaft in a predetermined direction of rotation so as to bring the shield into constant contact with the intake duct.

5. The fixing device according to claim 4, wherein the biasing member includes a torsion spring.

6. The fixing device according to claim 2, wherein the anti overheat assembly includes a first temperature detector disposed opposite the outer circumferential surface of the second rotary body to detect the temperature of the second rotary body, and wherein an amount of airflow generated by the airflow generator is adjusted based on the temperature of the second rotary body detected by the first temperature detector.

7. The fixing device according to claim 6, wherein the first temperature detector includes a non-contact temperature sensor disposed opposite a center of the outer circumferential surface of the second rotary body in an axial direction thereof.

8. The fixing device according to claim 7, wherein the anti overheat assembly further includes a second temperature detector disposed opposite one end of the outer circumferential surface of the second rotary body in the axial direction thereof to detect the temperature of the one end of the second rotary body, and wherein the amount of airflow generated by the airflow generator is adjusted based on the temperature of the one end of the second rotary body detected by the second temperature detector.

9. The fixing device according to claim 8, wherein the second temperature detector includes a thermistor.

10. The fixing device according to claim 9, wherein the anti overheat assembly further includes a thermostat interposed between the non-contact temperature sensor and the thermistor in the axial direction of the second rotary body.

11. The fixing device according to claim 1, wherein the first rotary body includes one of a fixing belt and a fixing roller and the second rotary body includes one of a pressing belt and a pressing roller.

12. The fixing device according to claim 1, wherein the moving assembly includes:

a movable unit shaft attached to the movable unit to move the movable unit;

a pressing lever contacting the second rotary body and connected to a frame of the movable unit mounted with the airflow guide; and a cam connected to the pressing lever, the cam to rotate the pressing lever that moves the second rotary body and the airflow guide between the first position and the second position.

13. An image forming apparatus comprising the fixing device according to claim 1.

* * * * *